US010889115B2

(12) United States Patent
Hirai et al.

(10) Patent No.: US 10,889,115 B2
(45) Date of Patent: Jan. 12, 2021

(54) LIQUID DISCHARGE HEAD HAVING A WIRING SUBSTRATE WITH SURFACE WIRINGS CONNECTED AT BOTH ENDS VIA THROUGH-WIRINGS

(71) Applicant: Seiko Epson Corporation, Tokyo (JP)

(72) Inventors: Eiju Hirai, Azumino (JP); Daisuke Yamada, Shiojiri (JP); Shingo Tomimatsu, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 16/442,831

(22) Filed: Jun. 17, 2019

(65) Prior Publication Data

US 2019/0381796 A1 Dec. 19, 2019

(30) Foreign Application Priority Data

Jun. 18, 2018 (JP) ..... 2018-115272

(51) Int. Cl.
*B41J 2/14* (2006.01)

(52) U.S. Cl.
CPC .. *B41J 2/14233* (2013.01); *B41J 2002/14362* (2013.01); *B41J 2002/14491* (2013.01); *B41J 2202/13* (2013.01)

(58) Field of Classification Search
CPC ..... B41J 2/14233
See application file for complete search history.

(56) References Cited

U.S. PATENT DOCUMENTS

2017/0066240 A1* 3/2017 Hirai ..... B41J 2/1629
2017/0106653 A1* 4/2017 Matsumoto ..... B41J 2/1629
2017/0266972 A1 9/2017 Hirai et al.
2018/0086073 A1* 3/2018 Takagi ..... B41J 2/1433

FOREIGN PATENT DOCUMENTS

JP 2017-168748 A 9/2017

* cited by examiner

*Primary Examiner* — Bradley W Thies
(74) *Attorney, Agent, or Firm* — Harness, Dickey & Pierce, P.L.C.

(57) ABSTRACT

There is provided a liquid discharge head including a first wiring through which a drive signal is input to a wiring substrate, in which the wiring substrate has a substrate having a first surface and a second surface that opposes the first surface, a second wiring formed on the first surface, a third wiring formed on the second surface, a fourth wiring and a fifth wiring that pass through the substrate and electrically couples the second wiring with the third wiring, and an electrode provided on the second wiring and electrically couples the second wiring with the first wiring, and the electrode is positioned between a first coupling point at which the fourth wiring is electrically coupled to the second wiring and a second coupling point at which the fifth wiring is electrically coupled to the second wiring, in the second wiring.

7 Claims, 15 Drawing Sheets

LIQUID DISCHARGE HEAD HAVING A WIRING SUBSTRATE WITH SURFACE WIRINGS CONNECTED AT BOTH ENDS VIA THROUGH-WIRINGS

The present application is based on, and claims priority from, JP Application Serial Number 2018-115272, filed Jun. 18, 2018, the disclosure of which is hereby incorporated by reference herein in its entirety.

BACKGROUND

1. Technical Field

The present disclosure relates to a liquid discharge head, a liquid discharge apparatus, and a wiring substrate.

2. Related Art

A liquid discharge apparatus such as an ink jet printer discharges a liquid such as ink filled in a cavity from nozzles by driving a drive element such as a piezoelectric element provided in a liquid discharge head by a drive signal to form characters and images on a recording medium. In such a liquid discharge head, in order to miniaturize the liquid discharge head, there is a structure in which a drive IC for outputting a drive signal input to the liquid discharge head based on a control signal input to the liquid discharge head likewise, is mounted on an actuator substrate on which a piezoelectric element is provided.

For example, JP-A-2017-168748 discloses a technology in which a drive IC is mounted on an actuator substrate via an interposer substrate (wiring substrate), and wirings through which drive signals are propagated are formed on both sides of the drive IC side of the wiring substrate and the actuator substrate side.

However, with the technology described in JP-A-2017-168748, there is a possibility that it becomes difficult to sufficiently reduce a wiring resistance occurring on the wiring substrate.

In order to respond to recent high-definition printing requirements, the number of nozzles formed in a liquid discharge head is increased, so that current propagated in a wiring substrate increases. In such a case, deterioration of drive signals propagated on the wiring substrate and heat generation of the wiring substrate may increase due to the wiring resistance occurring on the wiring substrate.

SUMMARY

According to an aspect of the present disclosure, there is provided a liquid discharge head including a drive element driven by a drive signal supplied thereto; an actuator substrate provided with the drive element; a drive IC that controls a supply of the drive signal to the drive element; a wiring substrate that propagates the drive signal to the drive IC; and a first wiring through which the drive signal is input to the wiring substrate, in which the wiring substrate has a substrate having a first surface and a second surface that opposes the first surface, a second wiring formed on the first surface, a third wiring formed on the second surface, a fourth wiring and a fifth wiring that pass through the substrate and electrically couple the second wiring with the third wiring, and an electrode provided on the second wiring and electrically couples the second wiring with the first wiring, and the electrode is positioned between a first coupling point at which the fourth wiring is electrically coupled to the second wiring and a second coupling point at which the fifth wiring is electrically coupled to the second wiring, in the second wiring.

In the liquid discharge head, the substrate may have a first side and a second side longer than the first side, and the electrode may be provided between the fourth wiring and the fifth wiring in a direction along the second side.

In the liquid discharge head, the drive IC may be provided on the wiring substrate, and the electrode may be provided between the fourth wiring and the drive IC.

In the liquid discharge head, the substrate may have a first side and a second side longer than the first side, and the electrode may be provided between the fourth wiring and the drive IC in a direction along the second side.

In the liquid discharge head, the second wiring may include a first buried wiring buried in the substrate, the third wiring may include a second buried wiring buried in the substrate, and when viewed from the first surface, a part of the first buried wiring may overlap with the electrode and a part of the second buried wiring may overlap with the electrode.

In the liquid discharge head, the wiring substrate may include a sixth wiring passing through the substrate and electrically coupling the second wiring with the third wiring, and a third coupling point at which the sixth wiring is electrically coupled to the second wiring, and the third coupling point may be positioned between the electrode and the second coupling point in the second wiring.

According to another aspect of the present disclosure, there is provided a liquid discharge apparatus including the aspect of the liquid discharge head and a drive circuit that outputs the drive signal.

According to still another aspect of the present disclosure, there is provided a wiring substrate provided in a liquid discharge head including a drive element driven by a drive signal supplied thereto, an actuator substrate provided with the drive element, a drive IC that controls a supply of the drive signal to the drive element, and a first wiring through which the drive signal is input, the wiring substrate including a substrate having a first surface and a second surface that opposes the first surface; a second wiring formed on the first surface; a third wiring formed on the second surface; a fourth wiring and a fifth wiring passing through the substrate and electrically coupling the second wiring with the third wiring; and an electrode provided on the second wiring and electrically coupling the second wiring with the first wiring, in which the electrode is positioned between a first coupling point at which the fourth wiring is electrically coupled to the second wiring and a second coupling point at which the fifth wiring is electrically coupled to the second wiring, in the second wiring.

DESCRIPTION OF EXEMPLARY EMBODIMENTS

Hereinafter, preferred embodiments of the present disclosure will be described with reference to the drawings. The drawings used are for convenience of explanation. Note that, the embodiments described below do not unreasonably limit the contents of the present disclosure described in the claims. In addition, all of the configurations described below are not necessarily indispensable constitutional requirements of the present disclosure.

Hereinafter, a liquid discharge head provided with a wiring substrate according to the present disclosure will be described by taking a liquid discharge head applied to a liquid discharge apparatus as a printing apparatus, as an example.

1 First Embodiment

1.1 Outline of Liquid Discharge Apparatus

Figure 1:
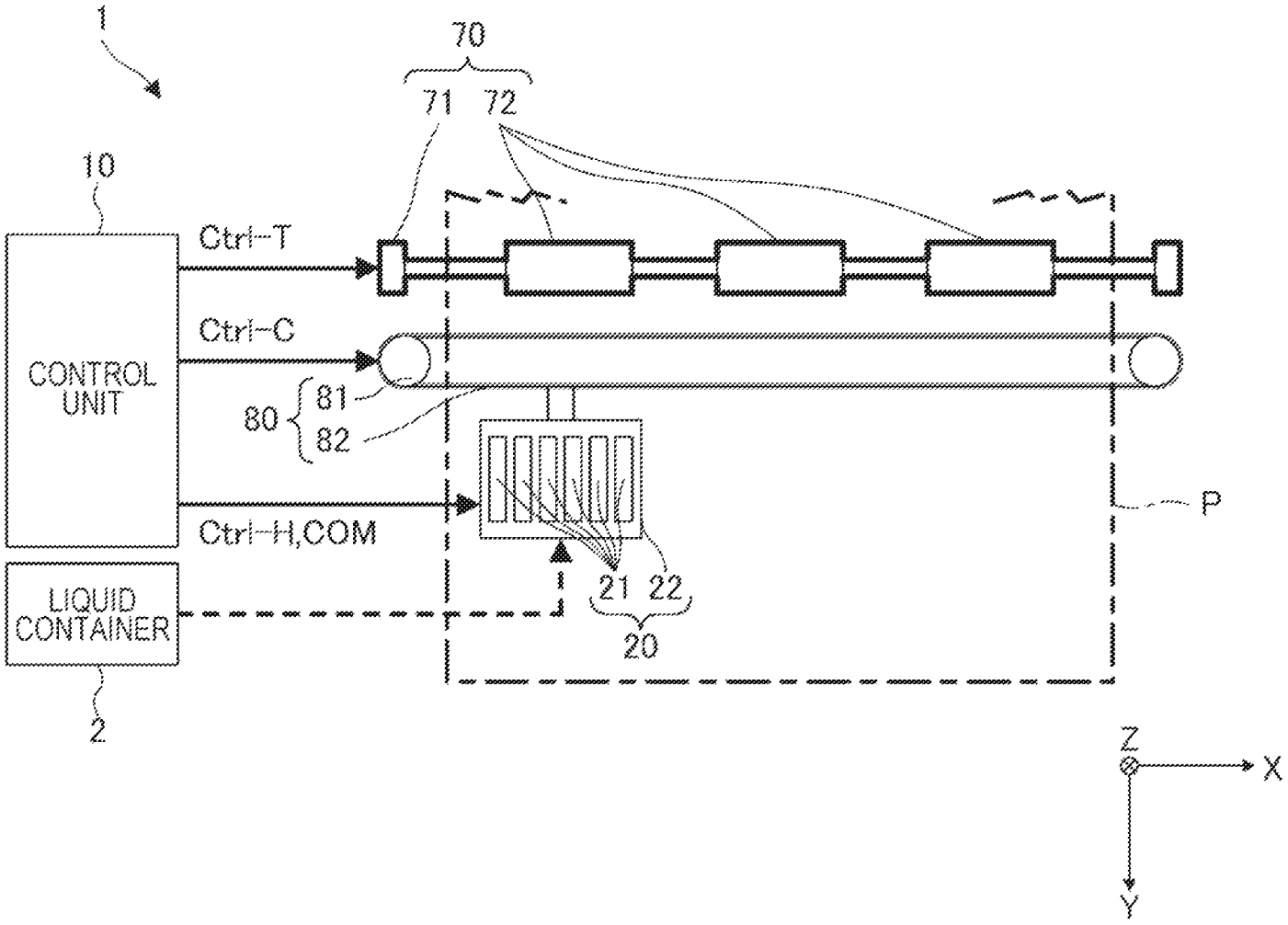
FIG. 1 is a diagram showing a schematic configuration of a liquid discharge apparatus.

FIG. 1 is a diagram showing a schematic configuration of a liquid discharge apparatus 1 to which a liquid discharge head of the present embodiment is applied. The liquid discharge apparatus 1 according to the present embodiment is a serial printing type ink jet printer where a carriage 22, on which liquid discharge heads 21 for discharging ink as an example of a liquid are mounted, reciprocates and ink is discharged onto a medium P to be transported. In the following description, it is assumed that an axis in which the carriage 22 moves is a X axis, a direction in which the medium P is transported is a Y direction, and a direction in which the ink is discharged is a Z direction. Note that in the following description, it is assumed that the X axis, the Y direction and the Z direction are orthogonal to each other. As the medium P, any printing target such as a printing paper, a resin film, and a cloth may be used.

The liquid discharge apparatus 1 includes a liquid container 2, a control unit 10, a head unit 20, a moving unit 80, and a transport unit 70.

In the liquid container 2, a plurality of kinds of inks to be discharged onto the medium P are stored. Specifically, six types of inks of black, cyan, magenta, yellow, red, and gray are stored in the liquid container 2. The number and types of inks stored in the liquid container 2 is merely an example, and the number of inks stored in the liquid container 2 may be five or less, or may be seven or more. Furthermore, inks of colors such as light cyan, light magenta, green may be stored in the liquid container 2. As the liquid container 2 in which such inks are stored, an ink cartridge, a bag-shaped ink pack formed of a flexible film, an ink tank capable of replenishing ink, or the like are used.

The control unit 10 includes a processing circuit such as a central processing unit (CPU), a field programmable gate array (FPGA), or the like and a memory circuit such as a semiconductor memory, and controls each element of the liquid discharge apparatus 1.

The head unit 20 includes the liquid discharge heads 21 and the carriage 22. The liquid discharge heads 21 are mounted on the carriage 22. The carriage 22 is fixed to an endless belt 82 included in the moving unit 80 in a state where the liquid discharge heads 21 are mounted. Note that the liquid container 2 may also be mounted on the carriage 22. Further, control signals Ctrl-H including a plurality of signals for controlling the liquid discharge heads 21 and one or a plurality of drive signals COM for driving the liquid discharge heads 21 are input from the control unit 10 to the liquid discharge heads 21. The liquid discharge heads 21 discharge ink supplied from the liquid container 2 in the Z direction based on the control signals Ctrl-H and one or more drive signals COM.

The moving unit 80 includes a carriage motor 81 and the endless belt 82. The carriage motor 81 operates based on a control signal Ctrl-C input from the control unit 10. The endless belt 82 pivots in accordance with an operation of the carriage motor 81. In this way, the carriage 22 fixed to the endless belt 82 reciprocates in the X axis.

The transport unit 70 includes a transport motor 71 and transport rollers 72. The transport motor 71 operates based on a control signal Ctrl-T input from the control unit 10. Then, the transport rollers 72 pivot according to an operation of the transport motor 71. The medium P is transported in the Y direction according to the pivot of the transport rollers 72.

As described above, the liquid discharge apparatus 1 causes ink to land at any position on a surface of the medium P to form a desired image on the medium P by discharging the ink from the liquid discharge heads 21 included in the head unit 20 in conjunction with the transport of the medium P by the transport unit 70 and the reciprocation of the head unit 20 by the moving unit 80 based on various signals output from the control unit 10.

1.2 Electrical Configuration of Liquid Discharge Apparatus

Figure 2:
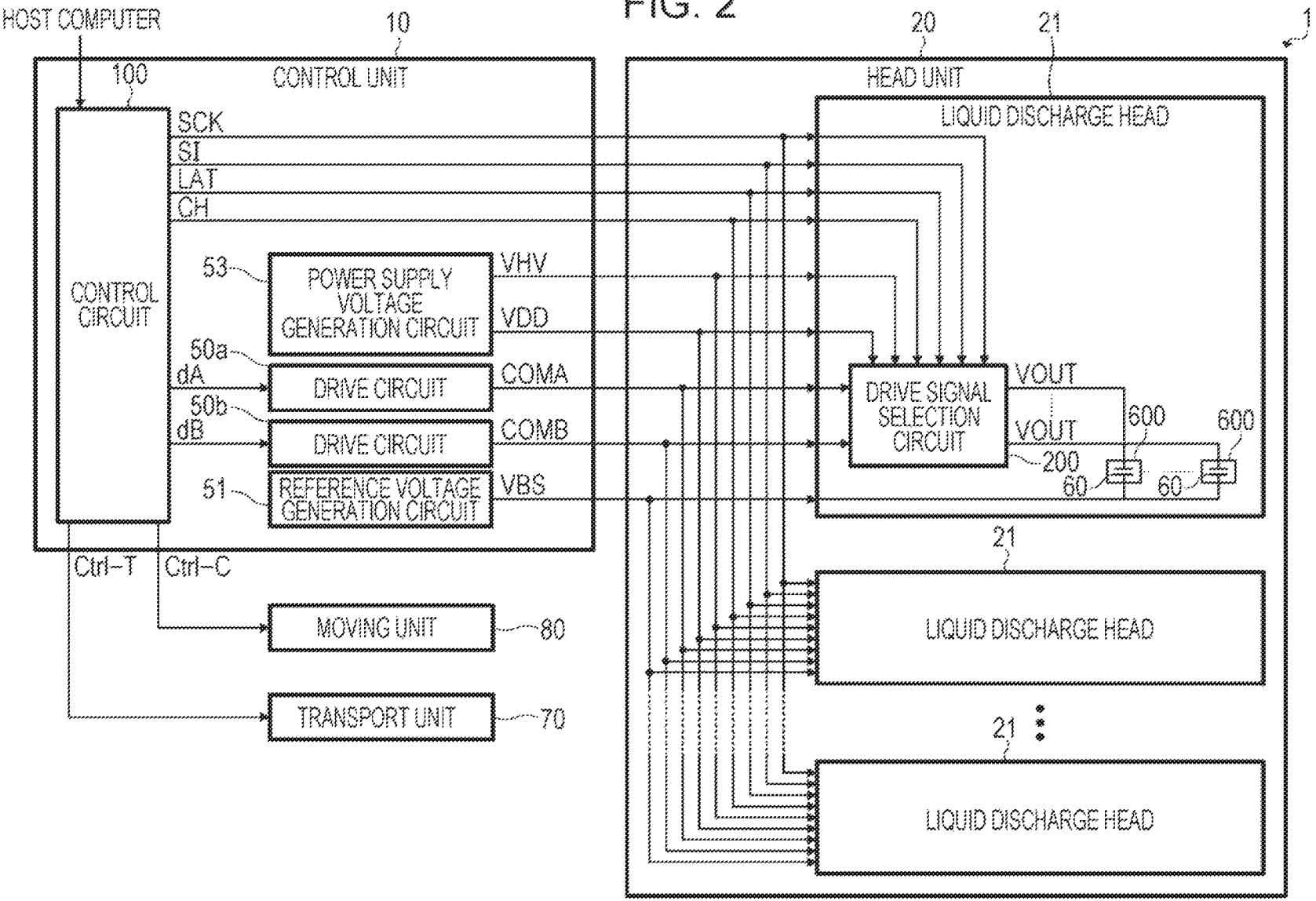
FIG. 2 is a block diagram showing an electrical configuration of the liquid discharge apparatus.

FIG. 2 is a block diagram showing an electrical configuration of the liquid discharge apparatus 1. The liquid discharge apparatus 1 includes the control unit 10, the head unit 20, the moving unit 80, and the transport unit 70. As shown in FIG. 2, the control unit 10 includes a control circuit 100, drive circuits 50*a* and 50*b*, a reference voltage generation circuit 51, and a power supply voltage generation circuit 53.

The control circuit 100 includes, for example, a processor such as a microcontroller. The control circuit 100 generates data or signals for controlling the liquid discharge apparatus 1 based on various signals such as image data supplied from a host computer.

Specifically, the control circuit 100 outputs the control signal Ctrl-C corresponding to a scanning position of the head unit 20 to the moving unit 80. Thus, the reciprocation of the head unit 20 is controlled. Further, the control circuit 100 outputs the control signal Ctrl-T to the transport unit 70. Consequently, the transportation of the medium P is controlled. Note that the control signal Ctrl-C may be supplied to the moving unit 80 after a signal conversion by a signal conversion circuit (not shown). Note that the control signal Ctrl-T may be supplied to the transport unit 70 after a signal conversion by the signal conversion circuit (not shown).

In addition, the control circuit 100 outputs a printing data signal SI, a change signal CH, a latch signal LAT, and a clock signal SCK as the control signal Ctrl-H for controlling the head unit 20 based on various signals such as image data supplied from the host computer.

Further, the control circuit 100 outputs drive control signals dA and dB which are digital signals of the drive circuits 50*a* and 50*b*, respectively.

Specifically, the drive control signal dA is input to the drive circuit 50*a*. The drive circuit 50*a* performs digital/analog conversion on the drive control signal dA, and then class-D amplifies the converted analog signal to generate the drive signal COMA. The drive circuit 50*a* outputs the generated drive signal COMA to the head unit 20. Further, the drive control signal dB is input to the drive circuit 50*b*. The drive circuit 50*b* performs digital/analog conversion on the drive control signal dB, and then class-D amplifies the converted analog signal to generate the drive signal COMB. The drive circuit 50*b* outputs the generated drive signal COMB to the head unit 20.

The reference voltage generation circuit 51 generates a reference voltage signal VBS supplied to piezoelectric elements 60 included in the head unit 20. The reference voltage signal VBS is, for example, a voltage signal of DC 6 V. Then, the reference voltage generation circuit 51 outputs the generated reference voltage signal VBS to the head unit 20. Note that the reference voltage generation circuit 51 may generate and output a voltage signal of a different voltage value other than DC 6 V.

The power supply voltage generation circuit 53 generates a high voltage signal VHV and a low voltage signal VDD. The high voltage signal VHV is, for example, a voltage signal of DC 42 V. The low voltage signal VDD is, for example, a voltage signal of 3.3V. Each of the high voltage signal VHV and the low voltage signal VDD is used as a power supply voltage of various configurations in the control unit 10 and is also output to the head unit 20. Note that the power supply voltage generation circuit 53 may generate various voltage signals other than the high voltage signal VHV and the low voltage signal VDD.

The head unit 20 includes a plurality of liquid discharge heads 21. The print data signal SI, the change signal CH, the latch signal LAT, the clock signal SCK, the drive signals COMA and COMB, the reference voltage signal VBS, the high voltage signal VHV and the low voltage signal VDD, which are input to the head unit 20, are branched in the head unit 20 and then supplied to each of the plurality of liquid discharge heads 21. Note that each of the plurality of liquid discharge heads 21 has the same configuration.

Each liquid discharge head 21 includes a drive signal selection circuit 200 and a plurality of discharge units 600. The drive signal selection circuit 200 generates drive signals VOUT by selecting or deselecting the drive signals COMA and COMB based on the input signals such as print data signal SI, the clock signal SCK, the latch signal LAT and the change signal CH. Then, the drive signal selection circuit 200 supplies the drive signal VOUT to the piezoelectric element included in the corresponding discharge unit 600. The piezoelectric element 60 is displaced when the drive signal VOUT is supplied. Then the amount of ink according to the displacement is discharged from the discharge unit 600. That is, the piezoelectric element 60 driven by the drive signal VOUT supplied thereto based on the drive signals COMA and COMB, is an example of a drive element.

1.3 Configuration of Liquid Discharge Head

Figure 3:
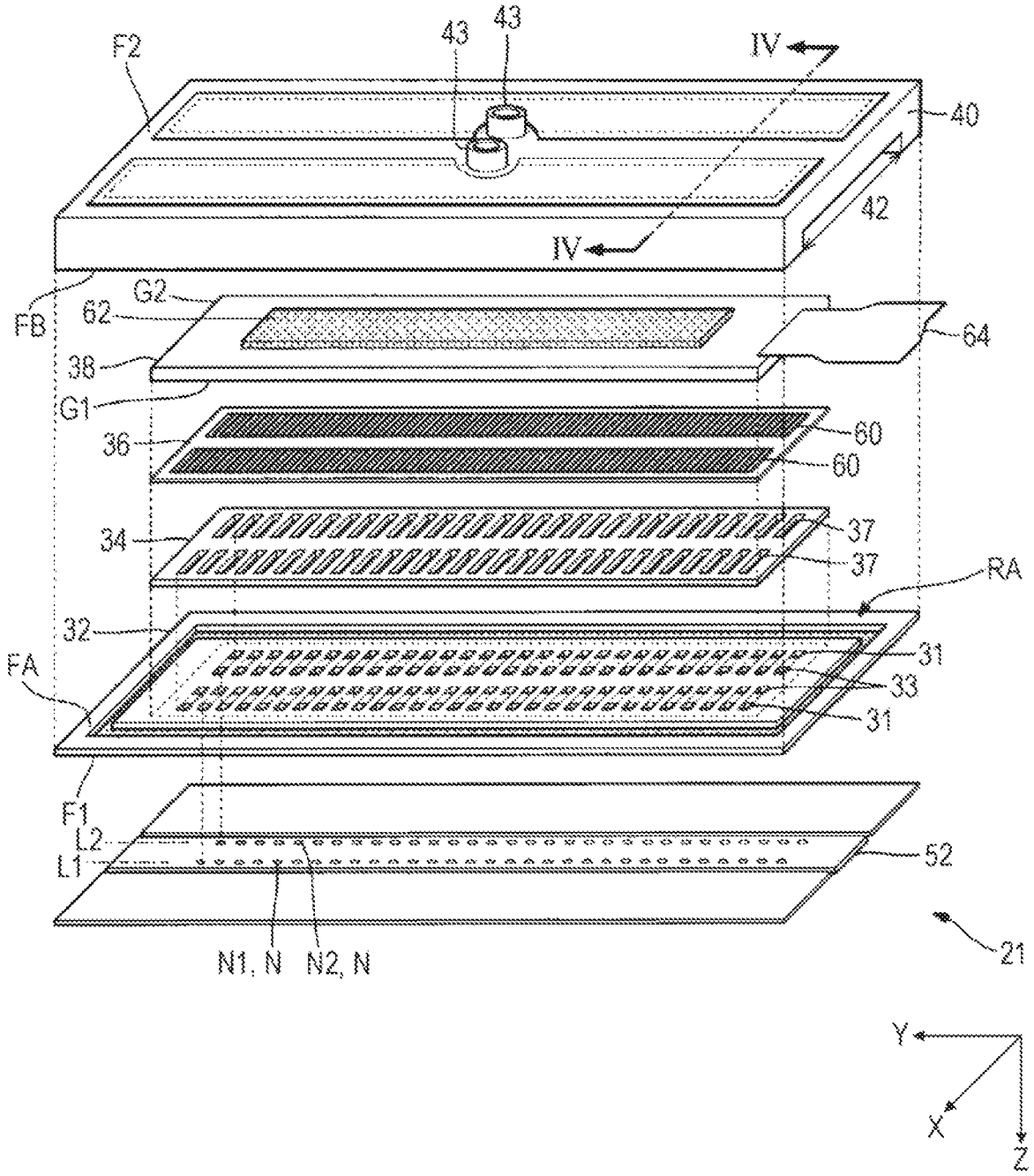
FIG. 3 is a disassembled perspective view of a liquid discharge head.
Figure 4:
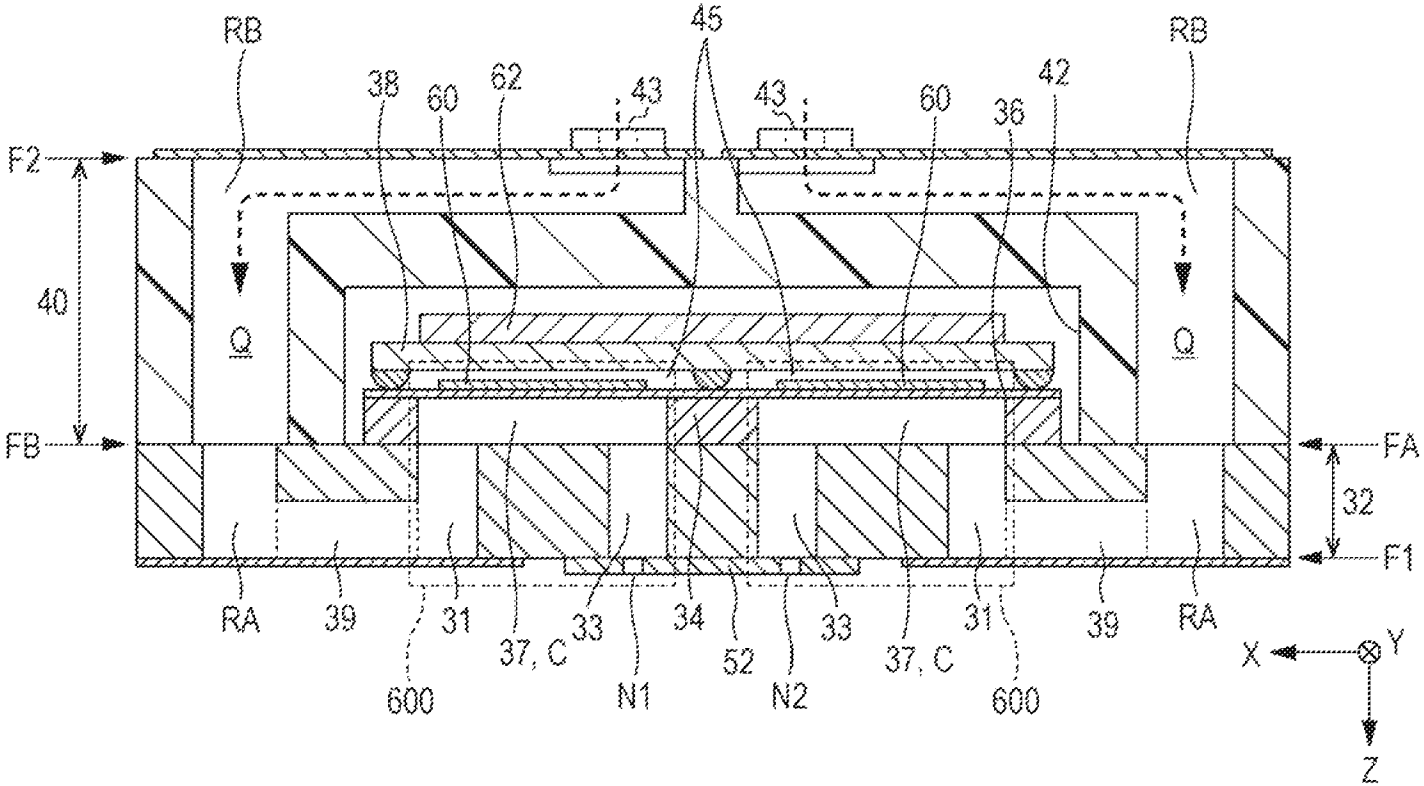
FIG. 4 is a cross-sectional view showing a cross section of the liquid discharge head taken along line IV-IV in FIG. 3.

A configuration of the liquid discharge head 21 will be described. FIG. 3 is a disassembled perspective view of a liquid discharge head 21. FIG. 4 is a cross-sectional view showing a cross section of the liquid discharge head 21 taken along the line IV-IV in FIG. 3.

As shown in FIG. 3, the liquid discharge head 21 includes 2M number of nozzles N arranged in the Y direction. In the present embodiment, 2M number nozzles N are arranged in two lines of a line L1 and a line L2. In the following description, each of the M number of nozzles N belonging to the line L1 will be referred to as nozzles N1, and each of the M number of nozzles N belonging to the line L2 will be referred to as nozzles N2. Further, in the following description, a case in which positions of a m-th (m is a natural number satisfying $1 \leq m \leq M$) nozzle N1 among the M number of nozzles N1 belonging to the line L1 and a m-th nozzle N2 among the M number of nozzles N2 belonging to the line L2 substantially coincide in the Y direction, is assumed. Here, "substantially coincide" includes not only cases where the positions are perfectly matched but also cases where the positions can be regarded as identical if margin of errors are considered. Note that 2M number of nozzles N may be arranged in so-called, a zigzag shape or a staggered shape, so that the position in the Y direction between the positions of the m-th nozzle N1 among the M number of nozzles N1 belonging to the line L1 and the m-th nozzle N2 among the M number of nozzles N2 belonging to the line L2 are different.

As shown in FIGS. 3 and 4, the liquid discharge head 21 includes a flow channel substrate 32. The flow channel substrate 32 is a plate-shaped member including a surface F1 and a surface FA. The surface F1 is a surface on the side of the medium P as viewed from the liquid discharge head 21, and the surface FA is a surface on the side opposite to the surface F1. On top of the surface of the surface FA, a pressure chamber substrate 34, an actuator substrate 36, a plurality of piezoelectric elements 60, a wiring substrate 38, and a housing portion 40 are provided. On top of the surface of the surface F1, a nozzle plate 52 and a vibration absorber 54 are provided. Each element of the liquid discharge head 21 is roughly a plate-shaped member elongated in the Y direction, and is stacked in the Z direction.

The nozzle plate 52 is a plate-shaped member, and 2M number of nozzles N, which are through holes, are formed in the nozzle plate 52. In the following description, 600 or more nozzles N are formed on the nozzle plate 52, and the nozzles N corresponding to each of the lines L1 and L2 are provided at a density of 300 or more nozzles per inch.

The flow channel substrate 32 is a plate-shaped member for forming a flow channel for ink. As shown in FIGS. 3 and 4, a flow channel RA is formed on the flow channel substrate 32. Further, on the flow channel substrate 32, 2M number of flow channels 31 and 2M number of flow channels 33 are formed so as to correspond to 2M number of nozzles N on a one-to-one basis. The flow channels 31 and the flow channels 33 are opening ports formed so as to pass through the flow channel substrate 32 as shown in FIG. 4. A flow channel 33 communicates with a nozzle N corresponding to the flow channel 33. Further, on the surface F1 of the flow channel substrate 32, two flow channels 39 are formed. One of the two flow channels 39 is a flow channel that connects the flow channel RA and M number of flow channels 31 corresponding one to one to the M number of nozzles N1 belonging to the line L1, and the other is a flow channel that connects the flow channel RA and M number of flow channels 31 corresponding one to one to the M number of nozzles N2 belonging to the line L2.

As shown in FIGS. 3 and 4, the pressure chamber substrate 34 is a plate-shaped member in which 2M number of opening ports 37 are formed so as to correspond to the 2M number of nozzles N in a one-to-one correspondence. On a surface of the pressure chamber substrate 34 opposite to the flow channel substrate 32, the actuator substrate 36 is provided.

As shown in FIG. 4, the actuator substrate 36 and the surface FA of the flow channel substrate 32 face each other with a space inside each opening port 37. The space located between the surface FA of the flow channel substrate 32 and the actuator substrate 36 inside the opening port 37 functions as a pressure chamber C for applying pressure to the ink filled in the space. The pressure chamber C is, for example, a space having an X axis as a longitudinal axis and a Y direction as a short axis. In the liquid discharge head 21, 2M number of pressure chambers C are provided so as to correspond to the 2M number of nozzles N on a one-to-one basis. The pressure chamber C provided corresponding to the nozzle N1 communicates with the flow channel RA via the flow channel 31 and the flow channel 39, and also communicates with the nozzle N1 via the flow channel 33. Further, the pressure chamber C provided corresponding to the nozzle N2 communicates with the flow channel RA via the flow channel 31 and the flow channel 39, and also communicates with the nozzle N2 via the flow channel 33.

As shown in FIGS. 3 and 4, on top of the surface of the actuator substrate 36 opposite to the pressure chamber C, 2M number of piezoelectric elements 60 are provided so as to correspond to the 2M number of pressure chambers C in a one-to-one basis. The drive signal VOUT based on the drive signals COMA and COMB is supplied to one end of the piezoelectric element 60, and the reference voltage signal VBS is supplied to the other end. The piezoelectric element 60 deforms (drives) in accordance with an electric potential difference between the drive signal VOUT and the reference voltage signal VBS. The actuator substrate 36 vibrates interlockingly with the deformation of the piezoelectric element 60, and when the actuator substrate 36 vibrates, a pressure in the pressure chamber C changes. As the pressure in the pressure chamber C changes, the ink filled in the pressure chamber C is discharged via the flow channel 33 and the nozzle N.

Note that the pressure chamber C, the flow channels 31 and 33, the nozzle N, the actuator substrate 36, and the piezoelectric element 60 function as the discharge unit 600 for discharging the ink filled in the pressure chamber C by driving the piezoelectric element 60. That is, in the liquid discharge head 21, a plurality of discharge units 600 are arranged in two lines along the Y direction.

The wiring substrate 38 shown in FIGS. 3 and 4 has a surface G1 and a surface G2 opposing the surface G1, and propagates drive signals COMA and COMB to the drive IC 62. The wiring substrate 38 is a plate-shaped member for protecting the 2M number of piezoelectric elements 60 formed on the actuator substrate 36, and is provided on the surface of the actuator substrate 36 or the surface of the pressure chamber substrate 34.

Two accommodation spaces 45 are formed on the surface G1 of the wiring substrate 38, which is a surface on the side of the medium P as viewed from the liquid discharge head 21. One of the two accommodation spaces 45 is a space for accommodating M number of piezoelectric elements 60 corresponding to the M number of nozzles N1 and the other is a space for accommodating M number of piezoelectric elements 60 corresponding to the M number of nozzles N2. A height which is a width in a Z direction of the accommodation space 45 is sufficiently large so that the piezoelectric element 60 and the wiring substrate 38 do not come into contact with each other even when the piezoelectric element 60 is displaced.

The drive IC 62 is provided on the surface G2 of the wiring substrate 38, which is a surface on the side opposite to the surface G1. For example, the drive signal selection circuit 200 shown in FIG. 2 is mounted on the drive IC 62. The drive signals COMA and COMB, the printing data signal SI, the change signal CH, the latch signal LAT and the clock signal SCK input to the liquid discharge head 21 are input to the drive IC 62. Then, based on the printing data signal SI, the drive IC 62 generates and outputs a drive signal VOUT by switching whether or not to supply the drive signals COMA and COMB to each piezoelectric element 60. That is, the drive IC 62 controls a supply of the drive signals COMA and COMB to the piezoelectric element 60.

A plurality of wirings are provided on the wiring substrate 38 for propagating the drive signals COMA, COMB, and VOUT, the print data signal SI, the change signal CH, the latch signal LAT and the clock signal SCK. The drive signal VOUT output from the drive IC 62 is supplied to the piezoelectric element 60 via the wiring.

In addition, a coupling wiring 64 is electrically coupled to the wiring substrate 38. The coupling wiring 64 is a member in which a plurality of wirings for transferring a plurality of signals input to the liquid discharge head 21 to the drive IC 62 are formed, and may be, for example, an flexible printed circuit (FPC), an flexible flat cable (FFC), or the like. In other words, the coupling wiring 64 inputs a plurality of signals including the drive signals COMA and COMB to the wiring substrate 38. Details of the plurality of wirings formed on the wiring substrate 38 will be described later. The coupling wiring 64 is an example of a first wiring.

An operation in which one of the drive signals COMA and COMB is selected in the drive IC 62 and the drive signal VOUT is generated, will be described. The drive IC 62 generates and outputs the drive signal VOUT supplied to the piezoelectric element 60 by selecting or deselecting the drive signals COMA and COMB based on the printing data signal SI, the change signal CH, and the latch signal LAT.

The latch signal LAT defines a printing cycle Ta, which is a cycle for forming dots on the medium P. Specifically, a cycle from a generation of the latch signal LAT to a next generation of the latch signal LAT becomes the printing cycle Ta. Further, the change signal CH divides the printing cycle Ta into a plurality of cycles Tn (n is a positive integer). The printing data signal SI includes data signals corresponding to each of a plurality of discharge units 600, and selects or deselects each of the drive signals COMA and COMB for each cycle Tn. In this way, the drive IC 62 generates the drive signal VOUT in the printing cycle Ta by selecting or deselecting each of the drive signals COMA and COMB for each cycle Tn based on the printing data signal SI.

Figure 5:
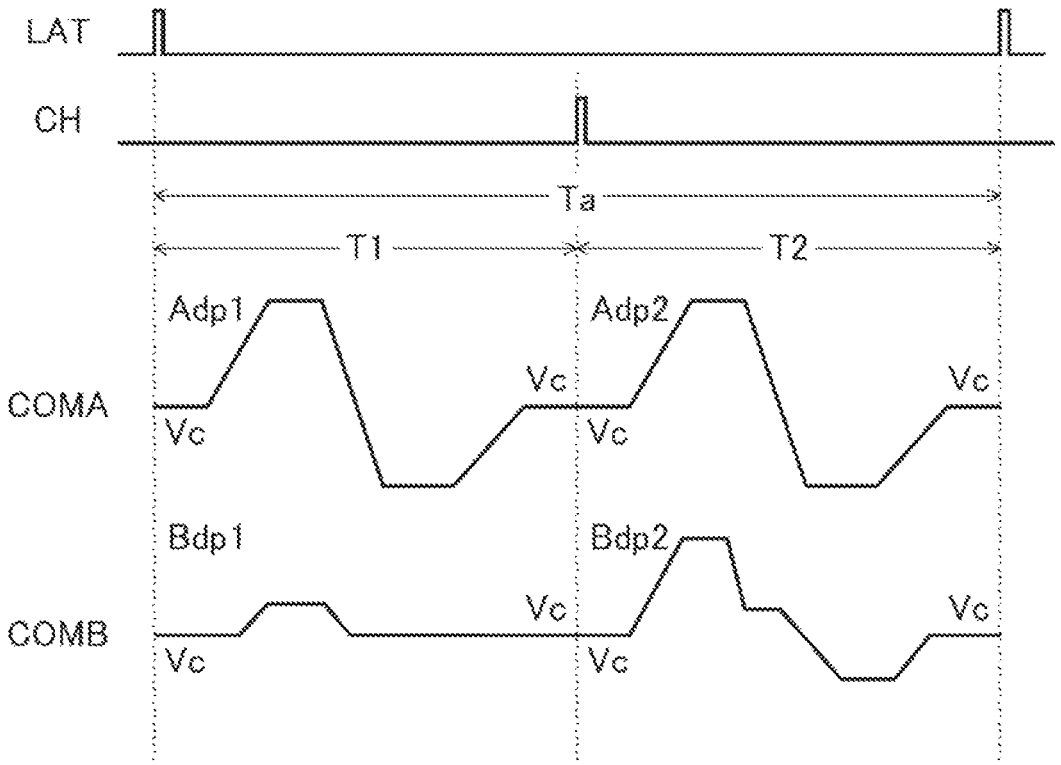
FIG. 5 is a diagram showing an example of drive signals.

A generation procedure of the drive signal VOUT in the drive IC 62 will be described by taking the drive signals COMA and COMB shown in FIG. 5 as an example. Note that the printing cycle Ta in FIG. 5 is configured with two cycles, which are a cycle T1 from a generation of the latch signal LAT to a generation of the change signal CH and a cycle T2 from a generation of the change signal CH to a generation of the latch signal LAT.

The drive signal COMA is a signal configured with a waveform in which a trapezoidal waveform Adp1 disposed in the cycle T1 and a trapezoidal waveform Adp2 disposed in the cycle T2 are continuous. The trapezoidal waveforms Adp1 and Adp2 have substantially the same waveforms, and when each of the waveforms is supplied to one end of the piezoelectric element 60, a moderate amount of ink is discharged from the corresponding nozzle N of the discharge unit 600.

The drive signal COMB is a signal configured with a waveform in which a trapezoidal waveform Bdp1 disposed in the cycle T1 and a trapezoidal waveform Bdp2 disposed in the cycle T2 are continuous. The trapezoidal waveforms Bdp1 and Bdp2 have different waveforms, and among the waveforms, the trapezoidal waveform Bdp1 is a waveform for slightly vibrating the ink in the vicinity of the opening portion of the nozzle N to prevent viscosity of the ink from increasing. Therefore, even if the trapezoidal waveform Bdp1 is supplied to one end of the piezoelectric element 60, an ink droplet is not discharged from the corresponding nozzle N of the discharge unit 600. The trapezoidal waveform Bdp2 is a waveform different from that of both of the trapezoidal waveforms Adp1 and Adp2, and when the trapezoidal waveform Bdp2 is supplied to one end of the piezoelectric element 60, a small amount of ink less than the moderate amount is discharged from the corresponding nozzle N of the discharge unit 600.

Based on the printing data signal SI, the drive IC 62 generates the drive signal VOUT by controlling whether to supply each of the drive signals COMA and COMB to each of the piezoelectric elements 60 included in the plurality of discharge units 600 in the cycle T1 and the cycle T2.

For example, when the printing data signal SI is a signal indicating "large dot", the drive signal COMA is selected in the cycles T1 and T2. As a result, the drive IC 62 outputs the drive signal VOUT configured with a waveform in which the trapezoidal waveform Adp1 and the trapezoidal waveform Adp2 are continuous in the printing cycle Ta. At this time, a moderate amount of ink is discharged twice from the nozzle N corresponding to the piezoelectric element 60 to which the drive signal VOUT is supplied. Therefore, a large dot is formed on the medium P.

Further, when the printing data signal SI is a signal indicating "medium dot", the drive signal COMA is selected in the cycle T1, and the drive signal COMB is selected in the cycle T2. As a result, the drive IC 62 outputs the drive signal VOUT configured with a waveform in which the trapezoidal waveform Adp1 and the trapezoidal waveform Bdp2 are continuous in the printing cycle Ta. At this time, a moderate amount of ink and a small amount of ink are discharged from the nozzle N corresponding to the piezoelectric element 60 to which the drive signal VOUT is supplied. Therefore, a medium dot is formed on the medium P.

Further, when the printing data signal SI is a signal indicating "small dot", neither the drive signals COMA and COMB are selected in the cycle T1, and the drive signal COMB is selected in the cycle T2. As a result, the drive IC 62 outputs the drive signal VOUT configured with the trapezoidal waveform Bdp2 in the printing cycle Ta. At this time, a small amount of ink is discharged from the nozzle N corresponding to the piezoelectric element 60 to which the drive signal VOUT is supplied. Therefore, a small dot is formed on the medium P.

Further, when the printing data signal SI is a signal indicating "micro vibration", the drive signal COMB is selected in the cycle T1, and neither the drive signals COMA nor COMB are selected in the cycle T2. As a result, the drive IC 62 outputs the drive signal VOUT configured with the trapezoidal waveform Bdp1 in the printing cycle Ta. At this time, the piezoelectric element 60 to which the drive signal VOUT is supplied is driven to such an extent that the ink is not discharged, and the ink is not discharged from the nozzle N corresponding to the piezoelectric element 60. Therefore, a dot is not formed on the medium P.

A voltage at the start timing of the trapezoidal waveforms Adp1, Adp2, Bdp1, and Bdp2 and a voltage at the end timing are common to the voltage Vc. That is, each of the drive signals COMA and COMB is configured with a waveform starting at the voltage Vc and ending at the voltage Vc. Note that the drive signals COMA and COMB shown in FIG. 5 are examples and are not limited thereto.

Returning to FIG. 3 and FIG. 4, a housing portion 40 is a case for storing the ink supplied to the 2M number of pressure chambers C. A surface FB of the casing portion 40, which is a surface on the side of the medium P as viewed from the liquid discharge head 21, is for example, fixed to the surface FA of the flow channel substrate 32 with an adhesive. On the surface FB of the casing portion 40, a groove-shaped concave portion 42 extending in the Y direction is formed. The wiring substrate 38 and the drive IC 62 are accommodated inside the concave portion 42. At this time, the coupling wiring 64 is extended in the Y direction so as to pass through inside of the concave portion 42.

The housing portion 40 is formed by, for example, injection molding of a resin material. As shown in FIG. 4, a flow channel RB communicating with the flow channel RA is formed in the housing portion 40. The flow channel RA and the flow channel RB function as a reservoir Q that stores the ink to be supplied to the 2M number of pressure chambers C.

On the surface F2 which is a surface opposite to the surface FB of the housing portion 40, two introducing ports 43 for introducing the ink supplied from the liquid container 2 to the reservoir Q, are provided. The ink supplied from the liquid container 2 to the two introducing ports 43 flows into the flow channel RA via the flow channel RB. A part of the ink flowed into the flow channel RA is supplied to the pressure chamber C corresponding to the nozzle N via the flow channel 39 and the flow channel 31. The ink filled in the pressure chamber C corresponding to the nozzle N is discharged from the nozzle N via the flow channel 33 by driving the piezoelectric element 60 corresponding to the nozzle N.

Figure 6:
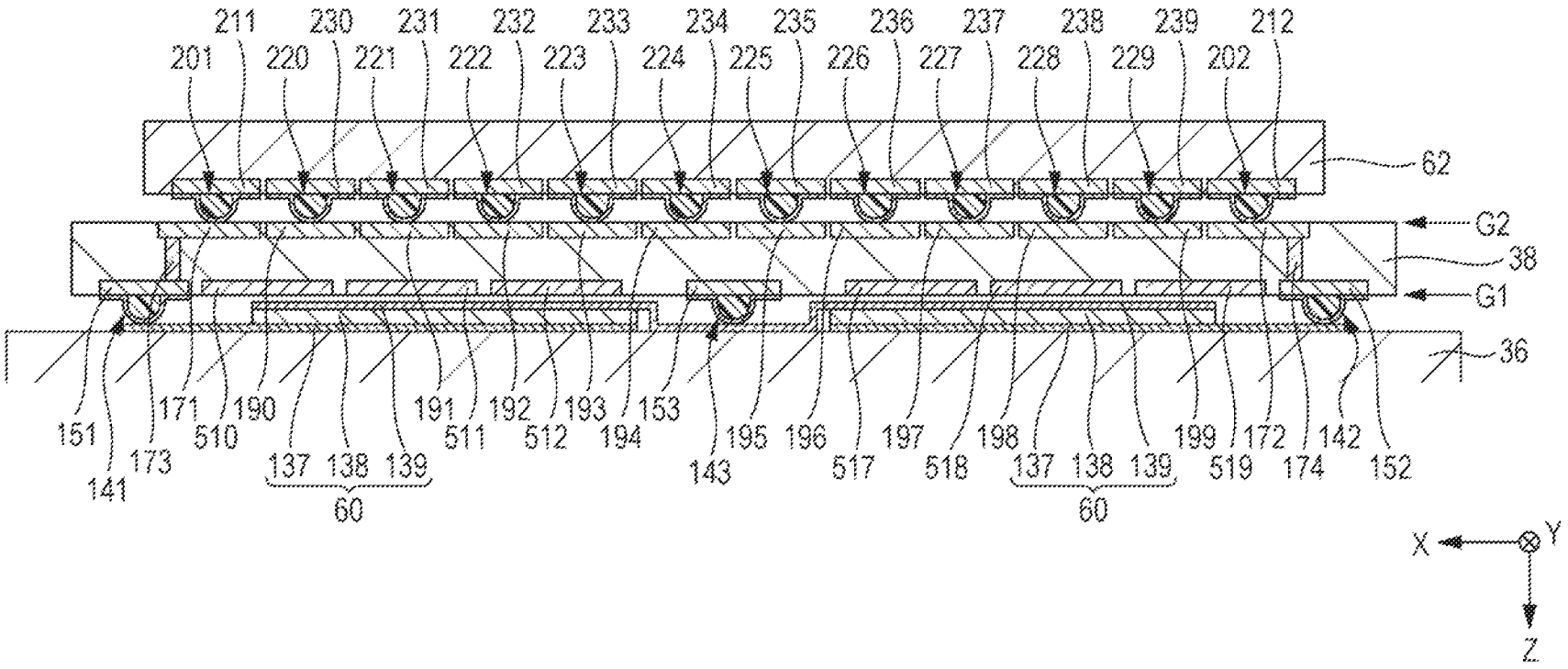
FIG. 6 is a diagram for explaining electrical couplings of a drive IC, a wiring substrate, an actuator substrate, and piezoelectric elements.

1.4 Configuration of Electrical Couplings of Drive IC, Wiring Substrate and Actuator Substrate Next, electrical couplings of the drive IC 62, the wiring substrate 38, the actuator substrate 36, and the piezoelectric element 60 will be described with reference to FIG. 6. FIG. 6 is a diagram for explaining electrical couplings of the drive IC 62, the wiring substrate 38, the actuator substrate 36, and the piezoelectric elements 60.

The actuator substrate 36 is a plate-shaped member and can vibrate. On an upper surface of the actuator substrate 36 in the Z direction, a plurality of piezoelectric elements 60 are arranged in two lines in the Y direction as shown in FIG. 3. In each piezoelectric element 60, a lower electrode layer 137, a piezoelectric layer 138, and an upper electrode layer 139 are sequentially stacked along the Z direction on an upper surface of the actuator substrate 36. The piezoelectric layer 138 is displaced in accordance with an electric potential difference generated between the lower electrode layer 137 and the upper electrode layer 139 of the piezoelectric element 60 configured as described above, and the actuator substrate 36 is deformed in the Z direction in accordance with the displacement of the piezoelectric layer 138.

In FIG. 6, the lower electrode layer 137 is an individual electrode that supplies the drive signal VOUT to each piezoelectric element 60, and the upper electrode layer 139 is a common electrode common to supply the reference voltage signal VBS to the plurality of piezoelectric elements 60. Note that the lower electrode layer 137 may be a common electrode and the upper electrode layer 139 may be an individual electrode.

On the upper surface of the actuator substrate 36 in the Z direction, the wiring substrate 38 is stacked. On the wiring substrate 38, a plurality of wirings and electrodes for supplying various signals to the actuator substrate 36 are provided. Details of the plurality of wirings and electrodes provided on the wiring substrate 38 will be described later.

On the surface G1 of the wiring substrate 38, bump electrodes 141 and 142 for supplying the drive signal VOUT output from the drive IC 62 to the corresponding piezoelectric element 60 are provided. The bump electrode 141 is provided inside the plurality of piezoelectric elements 60 arranged in two lines, for example, at a position corresponding to the lower electrode layer 137 of the piezoelectric element 60 corresponding to the nozzle N1 included in the line L1 shown in FIG. 3. The bump electrode 141 and the lower electrode layer 137 are electrically coupled to each other, whereby the drive signal VOUT is supplied to the piezoelectric element 60. Further, the bump electrode 141 is also electrically coupled to an electrode 151 formed on the surface G1 of the wiring substrate 38.

The bump electrode 142 is provided inside the plurality of piezoelectric elements 60 arranged in two lines, for example, at a position corresponding to the lower electrode layer 137 of the piezoelectric element 60 corresponding to the nozzle N2 included in the line L2 shown in FIG. 3. The bump electrode 142 and the lower electrode layer 137 are electrically coupled to each other, whereby the drive signal VOUT is supplied to the piezoelectric element 60. Further, the bump electrode 142 is also electrically coupled to an electrode 152 formed on the surface G1 of the wiring substrate 38.

A bump electrode 143 for supplying the reference voltage signal VBS to the piezoelectric element 60 is provided on the surface G1 of the wiring substrate 38. The bump electrode 143 is provided at a position corresponding to the upper electrode layer 139 of the piezoelectric element 60. The bump electrode 143 and the upper electrode layer 139 are electrically coupled to each other, whereby the reference voltage signal VBS is supplied to the piezoelectric element 60. Further, the bump electrode 143 is also electrically coupled to an electrode 153 formed on the surface G1 of the wiring substrate 38.

On the surface G1 of the wiring substrate 38, wirings 510 to 512 and 517 to 519 extending along the Y direction are formed along the X axis. Specifically, the wirings 510 to 512 are arranged in the order of the wirings 510, 511, and 512 in a direction from the electrode 151 toward the electrode 153 between the electrode 151 and the electrode 153. Further, the wirings 517 to 519 are arranged in the order of the wirings 517, 518, and 519 in a direction from the electrode 153 toward the electrode 152 between the electrode 153 and the electrode 152.

An electrode 171 corresponding to the electrode 151 is formed on the surface G2 of the wiring substrate 38 on the side opposite to the surface G1. The electrode 151 and the electrode 171 are electrically coupled by a through-wiring 173 passing through the wiring substrate 38.

An electrode 172 corresponding to the electrode 152 is formed on the surface G2 of the wiring substrate 38. The electrode 152 and the electrode 172 are electrically coupled by a through-wiring 174 passing through the wiring substrate 38.

On the surface G2 of the wiring substrate 38, electrodes 190 to 199 are formed between the electrode 171 and the electrode 172. Specifically, the electrodes 190 to 199 are arranged in the order of the electrodes 190, 191, 192, 193, 194, 195, 196, 197, 198, and 199 in a direction from the electrode 171 toward the electrode 172 between the electrode 151 and the electrode 153.

The drive IC 62 is mounted on the upper surface of the wiring substrate 38 in the Z direction. A bump electrode 201 is provided, on a surface of the drive IC 62 facing the wiring substrate 38 and in a region facing the electrode 171 of the wiring substrate 38. Further, the bump electrode 201 is also electrically coupled to an electrode 211 formed on the drive IC 62.

Similarly, a bump electrode 202 is provided, on a surface of the drive IC 62 facing the wiring substrate 38 and in a region facing the electrode 172 of the wiring substrate 38. Further, the bump electrode 202 is also electrically coupled to an electrode 212 formed on the drive IC 62.

Bump electrode 220 to 229 are provided, on a surface of the drive IC 62 facing the wiring substrate 38 and in a region facing each of the electrodes 190 to 199 of the wiring substrate 38. Further, each of the bump electrodes 220 to 229 is electrically coupled to each of the electrodes 230 to 239 formed on the drive IC 62.

The configuration of the bump electrodes 141 to 143, 201, 202, and 220 to 229 which are electrically coupled to the drive IC 62, the wiring substrate 38 and the actuator substrate 36, respectively, will be described with reference to FIG. 7. Note that the bump electrodes 141 to 143, 201, 202, and 220 to 229 have the same configuration, and in the description of FIG. 7, a bump electrode 240 will be described.

Figure 7:
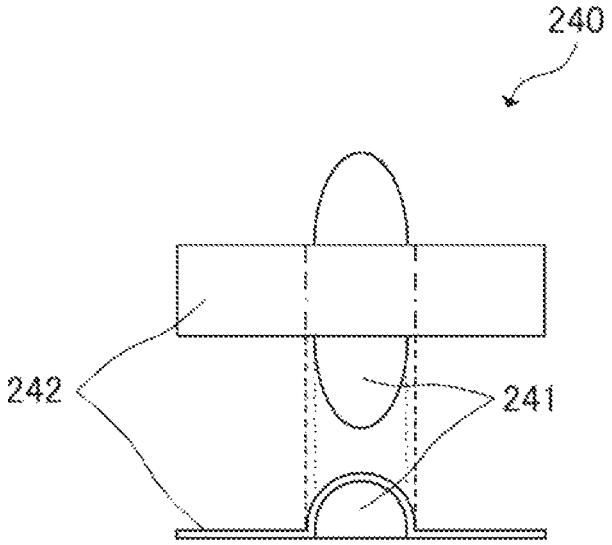
FIG. 7 is a diagram showing an example of a configuration of a bump electrode.

FIG. 7 is a diagram showing an example of a configuration of a bump electrode 240. A top view in FIG. 7 shows a plan view of the bump electrode 240, and a bottom view in FIG. 7 shows a side view of the bump electrode 240. The bump electrode 240 is a resin core bump including a resin core portion 241 protrudingly provided, and a metal electrode 242 formed on the upper part of the core portion 241. In such a bump electrode 240, a spacing between the bump electrodes 240 can be reduced since a space between patterns of the electrodes 242 can be constituted by an insulator core portion 241.

Note that in the present embodiment, although the bump electrode 240 is illustrated and described as including the core portion 241 and the electrode 242 individually, a plurality of bump electrodes 240 may be formed by forming a plurality of electrodes 242 on an upper part of the core portion 241 provided in common.

1.5 Configuration of Wiring Substrate

Figure 8:
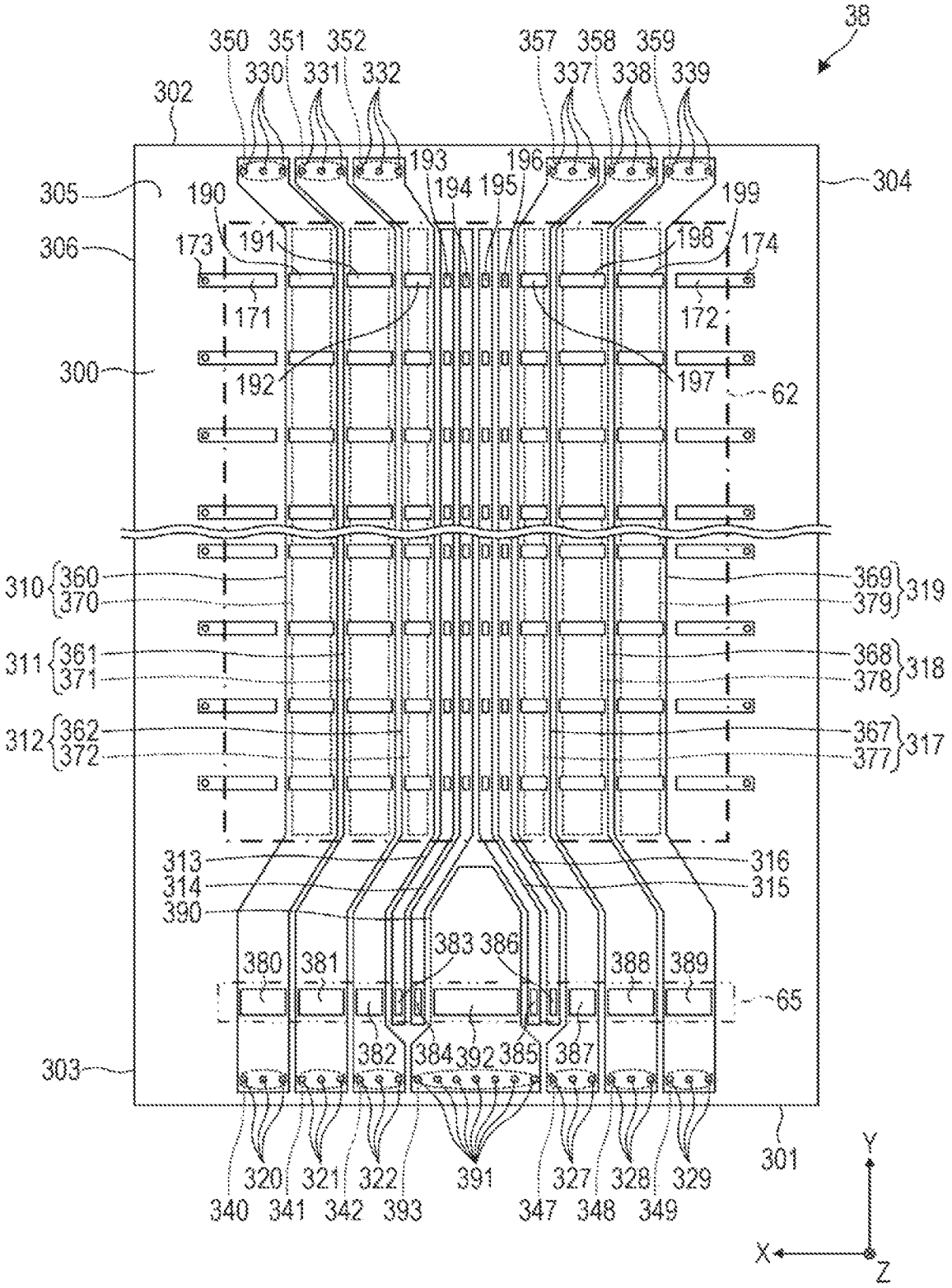
FIG. 8 is a diagram showing a configuration when the wiring substrate is viewed from a surface.
Figure 9:
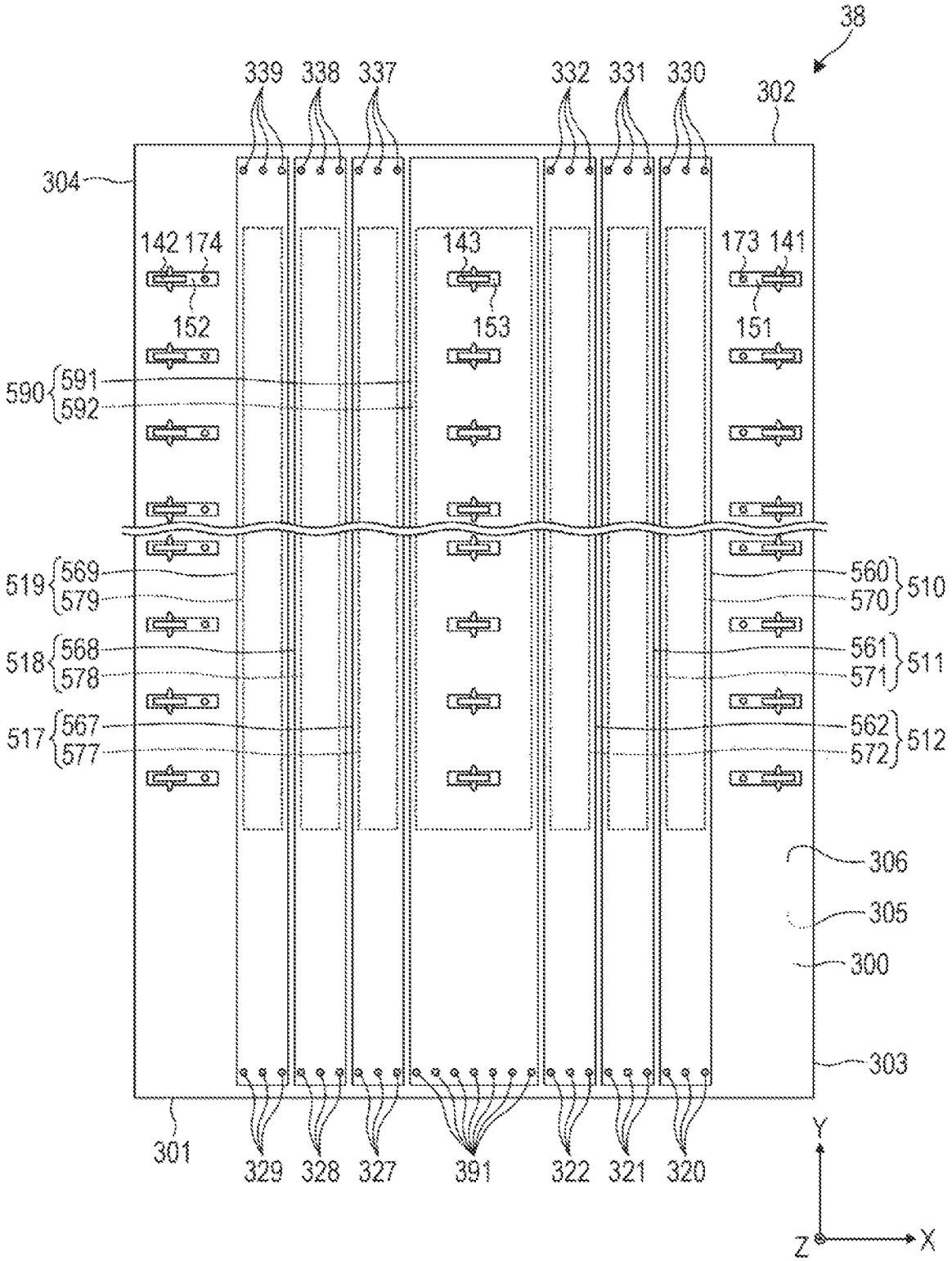
FIG. 9 is a diagram showing a configuration when the wiring substrate is viewed from a surface.

Details of a plurality of wirings and electrodes provided on the wiring substrate 38 will be described with reference to FIGS. 8 and 9. FIG. 8 is a plan view showing a configuration when the wiring substrate 38 is viewed from the surface G2. FIG. 9 is a plan view showing a configuration when the wiring substrate 38 is viewed from the surface Gl. In addition, in FIG. 8, the drive ICs 62 mounted on the wiring substrate 38 are indicated by one-dot chain lines.

As shown in FIGS. 8 and 9, the wiring substrate 38 includes a substrate 300.

The substrate 300 has a substantially rectangular shape which has a first surface 305 and a second surface 306 opposing the first surface 305, and which is formed by a side 301 that is an example of a first side, a side 302 that faces the side 301, a side 303 that is longer than the side 301 and is an example of a second side, and a side 304 opposite to the side 303. On the substrate 300, a coupling wiring region 65 including a plurality of electrodes to which the coupling wiring 64 is coupled, a plurality of wirings, and a plurality of electrodes, are formed. Note that the first surface 305 of the substrate 300 is a surface having the same direction as the surface G2 of the wiring substrate 38 and the second surface 306 of the substrate 300 is a surface having the same direction as the surface G1 of the wiring substrate 38.

Electrodes 380 to 389 and 392 to which the coupling wiring 64 is electrically coupled are formed in the coupling wiring region 65.

As shown in FIG. 8, the electrode 380 is formed on the wiring 310. The electrode 380 electrically couples the wiring 310 with the coupling wiring 64. The wiring 310 is a wiring pattern formed along the Y direction from the side 301 toward the side 302 on the first surface 305 of the substrate 300. The drive signal COMA is supplied to the electrode 380. The wiring 310 propagates the drive signal COMA input via the electrode 380. Further, an electrode 190 is formed on the wiring 310. The electrode 190 is electrically coupled to the bump electrode 220 as shown in FIG. 6. As a result, the drive signal COMA supplied via the electrode 380 is propagated through the wiring 310 and then supplied to the drive IC 62 via the bump electrode 220. In the present embodiment, M number of electrodes 190 are formed on the wiring 310 corresponding to each of the M number of nozzles N1 forming the line L1. In addition, M number of bump electrodes 220 are provided corresponding to the M number of electrodes 190.

A through-wiring 320 passing through the substrate 300 and electrically coupled to the wiring 310, is formed on a side closer to the side 301 than the electrode 380 in the wiring 310. The through-wiring 320 is electrically coupled to the wiring 310 at a coupling point 340. Further, a through-wiring 330 passing through the substrate 300 and electrically coupled to the wiring 310, is formed on a side closer to the side 302 than the electrode 380 in the wiring 310. The through-wiring 330 is electrically coupled to the wiring 310 at a coupling point 350. In other words, the electrode 380 is positioned between the coupling point 340 and the coupling point 350 in the wiring 310.

The through-wiring 320 and the through-wiring 330 are electrically coupled to the wiring 510 formed on the second surface 306 as shown in FIG. 9. That is, the through-wirings 320 and 330 pass through the substrate 300 and electrically couple the wirings 310 with 510. As a result, the drive signal COMA input via the electrode 380, is propagated through the wiring 510 via the wiring 310 and the through-wiring 320, and then is supplied to the drive IC 62 via the through-wiring 330, the wiring 310 and the bump electrode 220.

As shown in FIG. 8, the wiring 310 includes a buried wiring 370 buried in the substrate 300 and a surface layer wiring 360 formed so as to cover the buried wiring 370. As described above, since the wiring 310 through which the drive signal COMA is propagated includes the buried wiring 370, the size of the wiring substrate 38 can be reduced, a cross-sectional area of the wiring 310 through which the drive signal COMA is propagated can be increased, and a wiring resistance of the wiring 310 can be reduced. Note that the surface layer wiring 360 is formed so as to cover the buried wiring 370 means that the entire buried wiring 370 may not be necessarily covered with the surface layer wiring 360 and at least a part of the buried wiring 370 may be covered with the surface layer wiring 360.

As shown in FIG. 9, the wiring 510 includes a buried wiring 570 buried in the substrate 300 and a surface layer wiring 560 formed so as to cover the buried wiring 570. As described above, since the wiring 510 through which the drive signal COMA is propagated includes the buried wiring 570, the size of the wiring substrate 38 can be reduced, a cross-sectional area of the wiring 510 through which the drive signal COMA is propagated can be increased, and a wiring resistance of the wiring 510 can be reduced. Note that the surface layer wiring 560 is formed so as to cover the buried wiring 570 means that the entire buried wiring 570 may not be necessarily covered with the surface layer wiring 560 and at least a part of the buried wiring 570 may be covered with the surface layer wiring 560.

The wiring 310 is an example of a second wiring, the wiring 510 is an example of a third wiring, the through-wiring 320 is an example of a fourth wiring, and the through-wiring 330 is an example of a fifth wiring. Further, the coupling point 340 is an example of a first coupling point, and the coupling point 350 is an example of a second coupling point. The buried wiring 370 is an example of a first buried wiring, and the buried wiring 570 is an example of a second buried wiring.

As shown in FIG. 8, the electrode 380 may be positioned between the coupling point 340 and the drive IC 62 in a direction along the side 304. As a result, the drive signal COMA supplied from the connection wiring 64 is branched into a path which is propagated through the wiring 310 and is supplied to the drive IC 62, and a path which is propagated through the wiring 510 and is supplied to the drive IC 62, immediately after being input to the electrode 380. Therefore, the current flowing through each of the wiring 310 and the wiring 510 is reduced. Thus, it is possible to reduce a heat generation of the wiring substrate 38 caused by a current based on the propagation of the drive signal COMA, and a voltage drop of the drive signal COMA.

As shown in FIG. 8, the electrode 381 is formed on the wiring 311. The electrode 381 electrically couples the wiring 311 with the coupling wiring 64. The wiring 311 is a wiring pattern formed along the Y direction from the side 301 toward the side 302 on the side 304 side of the wiring 310 on the first surface 305 of the substrate 300. The drive signal COMB is supplied to the electrode 381. The wiring 311 propagates the drive signal COMB input via the electrode 381. Further, an electrode 191 is formed on the wiring 311. The electrode 191 is electrically coupled to the bump electrode 221 as shown in FIG. 6. As a result, the drive signal COMB supplied via the electrode 381 is propagated through the wiring 311 and then supplied to the drive IC 62 via the bump electrode 221. In the present embodiment, M number of electrodes 191 are formed on the wiring 311 corresponding to each of the M number of nozzles N1 forming the line L1. In addition, M number of bump electrodes 221 are provided corresponding to the M number of electrodes 191.

A through-wiring 321 passing through the substrate 300 and electrically coupled to the wiring 311, is formed on a side closer to the side 301 than the electrode 381 in the wiring 311. The through-wiring 321 is electrically coupled to the wiring 311 at a coupling point 341. Further, a through-wiring 331 passing through the substrate 300 and electrically coupled to the wiring 311, is formed on a side closer to the side 302 than the electrode 381 in the wiring 311. The through-wiring 331 is electrically coupled to the wiring 311 at a coupling point 351. In other words, the electrode 381 is positioned between the coupling point 341 and the coupling point 351 in the wiring 311.

The through-wiring 321 and the through-wiring 331 are electrically coupled to the wiring 511 formed on the second surface 306 as shown in FIG. 9. That is, the through-wirings 321 and 331 pass through the substrate 300 and electrically couple the wirings 311 with 511. As a result, the drive signal COMB input via the electrode 381, is propagated through the wiring 511 via the wiring 311 and the through-wiring 321, and then is supplied to the drive IC 62 via the through-wiring 331, the wiring 311 and the bump electrode 221.

As shown in FIG. 8, similarly to the wirings 310, the wiring 311 includes a buried wiring 371 buried in the substrate 300 and a surface layer wiring 361 formed so as to cover the buried wiring 371. Therefore, the size of the wiring substrate 38 can be reduced, a cross-sectional area of the wiring 311 through which the drive signal COMB is propagated can be increased, and thus a wiring resistance of the wiring 311 can be reduced.

As shown in FIG. 9, similarly to the wirings 510, the wiring 511 includes a buried wiring 571 buried in the substrate 300 and a surface layer wiring 561 formed so as to cover the buried wiring 571. Therefore, the size of the wiring substrate 38 can be reduced, a cross-sectional area of the wiring 511 through which the drive signal COMB is propagated can be increased, and thus a wiring resistance of the wiring 511 can be reduced.

The wiring 311 is another example of the second wiring, the wiring 511 is another example of the third wiring, the through-wiring 321 is another example of the fourth wiring, and the through-wiring 331 is another example of the fifth wiring. Further, the coupling point 341 is another example of the first coupling point, and the coupling point 351 is another example of the second coupling point. The buried wiring 371 is another example of the first buried wiring, and the buried wiring 571 is another example of the second buried wiring.

As shown in FIG. 8, the electrode 381 may be positioned between the coupling point 341 and the drive IC 62 in a direction along the side 304. As a result, the drive signal COMB supplied from the coupling wiring 64 branched into a path which is propagated through the wiring 311 and is supplied to the drive IC 62, and a path which is propagated through the wiring 511 and is supplied to the drive IC 62, immediately after being input to the electrode 381. Therefore, the current flowing through each of the wiring 311 and the wiring 511 is reduced. Thus, it is possible to reduce a heat generation of the wiring substrate 38 caused by a current based on the propagation of the drive signal COMB, and a voltage drop of the drive signal COMB.

As shown in FIG. 8, the electrode 382 is formed on the wiring 312. The electrode 382 electrically couples the wiring 312 with the coupling wiring 64. The wiring 312 is a wiring pattern formed along the Y direction extending from the side 301 toward the side 302 on the first surface 305 of the substrate 300 and on the side of the side 304 of the wiring 311. The high voltage signal VHV is supplied to the electrode 382. The wiring 312 propagates the high voltage signal VHV input via the electrode 382. Further, an electrode 192 is formed on the wiring 312. The electrode 192 is electrically coupled to the bump electrode 222 as shown in FIG. 6. As a result, the high voltage signal VHV supplied via the electrode 382 is propagated through the wiring 312 and then supplied to the drive IC 62 via the bump electrode 222. In the present embodiment, M number of electrodes 192 are formed on the wiring 312 corresponding to each of the M number of nozzles N1 or nozzles N2 forming the line L1 or the line L2. In addition, M number of bump electrodes 222 are provided corresponding to the M number of electrodes 192. The electrode 192 and the bump electrode 222 for supplying the high voltage signal VHV to the drive IC 62 may not be provided corresponding to the M number of nozzles N1 or nozzles N2, for example, the high voltage signal VHV may be supplied to the drive IC 62 via one electrode 192 and one bump electrode 222.

A through-wiring 322 passing through the substrate 300 and electrically coupled to the wiring 312, is formed on a side closer to the side 301 than the electrode 382 in the wiring 312. The through-wiring 322 is electrically coupled to the wiring 312 at a coupling point 342. Further, a through-wiring 332 passing through the substrate 300 and electrically coupled to the wiring 312, is formed on a side closer to the side 302 than the electrode 382 in the wiring 312. The through-wiring 332 is electrically coupled to the wiring 312 at a coupling point 352. In other words, the electrode 382 is positioned between the coupling point 342 and the coupling point 352 in the wiring 312.

The through-wiring 322 and the through-wiring 332 are electrically coupled to the wiring 512 formed on the second surface 306 as shown in FIG. 9. That is, the through-wirings 322 and 332 pass through the substrate 300 and electrically couple the wirings 312 with 512. As a result, the high voltage signal VHV input via the electrode 382, is propagated through the wiring 512 via the wiring 312 and the through-wiring 322, and then is supplied to the drive IC 62 via the through-wiring 332, the wiring 312 and the bump electrode 222.

As shown in FIG. 8, similarly to the wirings 310, the wiring 312 includes a buried wiring 372 buried in the substrate 300 and a surface layer wiring 362 formed so as to cover the buried wiring 372. Therefore, the size of the wiring substrate 38 can be reduced, a cross-sectional area of the wiring 312 through which the high voltage signal VHV is propagated can be increased, and thus a wiring resistance of the wiring 312 can be reduced.

As shown in FIG. 9, similarly to the wirings 510, the wiring 512 includes a buried wiring 572 buried in the substrate 300 and a surface layer wiring 562 formed so as to cover the buried wiring 572. Therefore, the size of the wiring substrate 38 can be reduced, a cross-sectional area of the wiring 512 through which the high voltage signal VHV is propagated can be increased, and thus a wiring resistance of the wiring 512 can be reduced.

As shown in FIG. 8, the electrode 382 may be positioned between the coupling point 342 and the drive IC 62 in a direction along the side 304. As a result, the high voltage signal VHV supplied from the coupling wiring 64 is branched into a path which is propagated through the wiring 312 and is supplied to the drive IC 62, and a path which is propagated through the wiring 512 and is supplied to the drive IC 62, immediately after being input to the electrode 382. Therefore, the current flowing through each of the wiring 312 and the wiring 512 is reduced. Thus, it is possible to reduce a heat generation of the wiring substrate 38 caused by a current based on the propagation of the high voltage signal VHV, and a voltage drop of the high voltage signal VHV.

As shown in FIG. 8, each of the electrodes 383 to 386 is formed on each wiring of the wirings 313 to 316. Each of the electrodes 383 to 386 electrically couples each of the wirings 313 to 316 with the coupling wiring 64. The wiring 313 is a wiring pattern formed along the Y direction from the side 301 toward the side 302 on the side 304 side of the wiring 312 on the first surface 305 of the substrate 300. The wiring 314 is a wiring pattern formed along the Y direction from the side 301 toward the side 302 on the side 304 side of the wiring 313 on the first surface 305 of the substrate 300. The wiring 315 is a wiring pattern formed along the Y direction from the side 301 toward the side 302 on the side 304 side of the wiring 314 on the first surface 305 of the substrate 300. The wiring 316 is a wiring pattern formed along the Y direction from the side 301 toward the side 302 on the side 304 side of the wiring 315 on the first surface 305 of the substrate 300. Each of the wirings 313 to 316 propagates the printing data signal SI, the change signal CH, the latch signal LAT and the clock signal SCK which are input via each of the electrodes 383 to 386.

Each of electrodes 193 to 196 is formed on each wiring of the wirings 313 to 316. Each of the electrodes 193 to 196 is electrically coupled to each of the bump electrodes 223 to 226 as shown in FIG. 6. As a result, the printing data signal SI, the change signal CH, the latch signal LAT, and the clock signal SCK are supplied to the drive IC 62. In the present embodiment, each of the electrodes 193 to 196 is formed by M number of electrodes along the Y direction corresponding to the M number of nozzles N1 or nozzles N2 forming the line L1 or L2. In addition, each of the bump electrodes 223 to 226 is formed by M number of bump electrodes corresponding to each of the electrodes 193 to 196.

As shown in FIG. 8, the electrode 387 is formed on the wiring 317. The electrode 387 electrically couples the wiring 317 with the coupling wiring 64. The wiring 317 is a wiring pattern formed along the Y direction from the side 301 toward the side 302 on the side 304 side of the wiring 316 on the first surface 305 of the substrate 300. The low voltage signal VDD is supplied to the electrode 387. The wiring 317 propagates the low voltage signal VDD input via the electrode 387. Further, an electrode 197 is formed on the wiring 317. The electrode 197 is electrically coupled to the bump electrode 227 as shown in FIG. 6. As a result, the low voltage signal VDD supplied via the electrode 387 is propagated through the wiring 317 and then supplied to the drive IC 62 via the bump electrode 227. In the present embodiment, M number of electrodes 197 are formed on the wiring 317 corresponding to each of the M number of nozzles N1 or nozzles N2 forming the line L1 or the line L2. In addition, M number of bump electrodes 227 are provided corresponding to the M number of electrodes 197. The electrode 197 and the bump electrode 227 for supplying the low voltage signal VDD to the drive IC 62 may not be provided corresponding to the M number of nozzles N1 or nozzles N2, for example, the low voltage signal VDD may be supplied to the drive IC 62 via one electrode 197 and one bump electrode 227.

A through-wiring 327 passing through the substrate 300 and electrically coupled to the wiring 317, is formed on a side closer to the side 301 than the electrode 387 in the wiring 317. The through-wiring 327 is electrically coupled to the wiring 317 at a coupling point 347. Further, a through-wiring 337 passing through the substrate 300 and electrically coupled to the wiring 317, is formed on a side closer to the side 302 than the electrode 387 in the wiring 317. The through-wiring 337 is electrically coupled to the wiring 317 at a coupling point 357. In other words, the electrode 387 is positioned between the coupling point 347 and the coupling point 357 in the wiring 317.

The through-wiring 327 and the through-wiring 337 are electrically coupled to the wiring 517 formed on the second surface 306 as shown in FIG. 9. That is, the through-wirings 327 and 337 pass through the substrate 300 and electrically couple the wirings 317 with 517. As a result, the low voltage signal VDD input via the electrode 387, is propagated through the wiring 517 via the wiring 317 and the through-wiring 327, and then is supplied to the drive IC 62 via the through-wiring 337, the wiring 317 and the bump electrode 227.

As shown in FIG. 8, similarly to the wirings 310, the wiring 317 includes a buried wiring 377 buried in the substrate 300 and a surface layer wiring 367 formed so as to cover the buried wiring 377. Therefore, the size of the wiring substrate 38 can be reduced, a cross-sectional area of the wiring 317 through which the low voltage signal VDD is propagated can be increased, and thus a wiring resistance of the wiring 317 can be reduced.

As shown in FIG. 9, similarly to the wirings 510, the wiring 517 includes a buried wiring 577 buried in the substrate 300 and a surface layer wiring 567 formed so as to cover the buried wiring 577. Therefore, the size of the wiring substrate 38 can be reduced, a cross-sectional area of the wiring 517 through which the low voltage signal VDD is propagated can be increased, and thus a wiring resistance of the wiring 517 can be reduced.

As shown in FIG. 8, the electrode 387 may be positioned between the coupling point 347 and the drive IC 62 in a direction along the side 304. As a result, the low voltage signal VDD supplied from the coupling wiring 64 is branched into a path which is propagated through the wiring 317 and is supplied to the drive IC 62, and a path which is propagated through the wiring 517 and is supplied to the drive IC 62, immediately after being input to the electrode 387. Therefore, the current flowing through each of the wiring 317 and the wiring 517 is reduced. Thus, it is possible to reduce a heat generation of the wiring substrate 38 caused by a current based on the propagation of the low voltage signal VDD, and a voltage drop of the low voltage signal VDD.

As shown in FIG. 8, the electrode 388 is formed on the wiring 318. The electrode 388 electrically couples the wiring 318 with the coupling wiring 64. The wiring 318 is a wiring pattern formed along the Y direction from the side 301 toward the side 302 on the side 304 side of the wiring 317 on the first surface 305 of the substrate 300. The drive signal COMB is supplied to the electrode 388. The wiring 318 propagates the drive signal COMB input via the electrode 388. Further, an electrode 198 is formed on the wiring 318. The electrode 198 is electrically coupled to the bump electrode 228 as shown in FIG. 6. As a result, the drive signal COMB supplied via the electrode 388 is propagated through the wiring 318 and then supplied to the drive IC 62 via the bump electrode 228. In the present embodiment, M number of electrodes 198 are formed on the wiring 318 corresponding to each of the M number of nozzles N2 forming the line L2. In addition, M number of bump electrodes 228 are provided corresponding to the M number of electrodes 198.

A through-wiring 328 passing through the substrate 300 and electrically coupled to the wiring 318, is formed on a side closer to the side 301 than the electrode 388 in the wiring 318. The through-wiring 328 is electrically coupled to the wiring 318 at a coupling point 348. Further, a through-wiring 338 passing through the substrate 300 and electrically coupled to the wiring 318, is formed on a side closer to the side 302 than the electrode 388 in the wiring 318. The through-wiring 338 is electrically coupled to the wiring 318 at a coupling point 358. In other words, the electrode 388 is positioned between the coupling point 348 and the coupling point 358 in the wiring 318.

The through-wiring 328 and the through-wiring 338 are electrically coupled to the wiring 518 formed on the second surface 306 as shown in FIG. 9. That is, the through-wirings 328 and 338 pass through the substrate 300 and electrically couple the wirings 318 with 518. As a result, the drive signal COMB input via the electrode 388, is propagated through the wiring 518 via the wiring 318 and the through-wiring 328, and then is supplied to the drive IC 62 via the through-wiring 338, the wiring 318 and the bump electrode 228.

As shown in FIG. 8, similarly to the wirings 310, the wiring 318 includes a buried wiring 378 buried in the substrate 300 and a surface layer wiring 368 formed so as to cover the buried wiring 378. Therefore, the size of the wiring substrate 38 can be reduced, a cross-sectional area of the wiring 318 through which the drive signal COMB is propagated can be increased, and thus a wiring resistance of the wiring 318 can be reduced.

As shown in FIG. 9, similarly to the wirings 510, the wiring 518 includes a buried wiring 578 buried in the substrate 300 and a surface layer wiring 568 formed so as to cover the buried wiring 578. Therefore, the size of the wiring substrate 38 can be reduced, a cross-sectional area of the wiring 518 through which the drive signal COMB is propagated can be increased, and thus a wiring resistance of the wiring 518 can be reduced.

The wiring 318 is another example of the second wiring, the wiring 518 is another example of the third wiring, the through-wiring 328 is another example of the fourth wiring, and the through-wiring 338 is another example of the fifth wiring. Further, the coupling point 348 is another example of the first coupling point, and the coupling point 358 is another example of the second coupling point. The buried wiring 378 is another example of the first buried wiring, and the buried wiring 578 is another example of the second buried wiring.

As shown in FIG. 8, the electrode 388 may be positioned between the coupling point 348 and the drive IC 62 in a direction along the side 304. As a result, the drive signal COMB supplied from the coupling wiring 64 branched into a path which is propagated through the wiring 318 and is supplied to the drive IC 62, and a path which is propagated through the wiring 518 and is supplied to the drive IC 62, immediately after being input to the electrode 388. Therefore, the current flowing through each of the wiring 318 and the wiring 518 is reduced. Thus, it is possible to reduce a heat generation of the wiring substrate 38 caused by a current based on the propagation of the drive signal COMB, and a voltage drop of the drive signal COMB.

As shown in FIG. 8, the electrode 389 is formed on the wiring 319. The electrode 380 electrically couples the wiring 310 with the coupling wiring 64. The wiring 319 is a wiring pattern formed along the Y direction from the side 301 toward the side 302 on the side 304 side of the wiring 318 on the first surface 305 of the substrate 300. The drive signal COMA is supplied to the electrode 389. The wiring 319 propagates the drive signal COMA input via the electrode 389. Further, an electrode 199 is formed on the wiring 319. The electrode 199 is electrically coupled to the bump electrode 229 as shown in FIG. 6. As a result, the drive signal COMA supplied via the electrode 389 is propagated through the wiring 319 and then supplied to the drive IC 62 via the bump electrode 229. In the present embodiment, M number of electrodes 199 are formed on the wiring 319 corresponding to each of the M number of nozzles N2 forming the line L2. In addition, M number of bump electrodes 229 are provided corresponding to the M number of electrodes 199.

A through-wiring 329 passing through the substrate 300 and electrically coupled to the wiring 319, is formed on a side closer to the side 301 than the electrode 389 in the wiring 319. The through-wiring 329 is electrically coupled to the wiring 319 at a coupling point 349. Further, a through-wiring 339 passing through the substrate 300 and electrically coupled to the wiring 319, is formed on a side closer to the side 302 than the electrode 389 in the wiring 319. The through-wiring 339 is electrically coupled to the wiring 319 at a coupling point 359. In other words, the electrode 389 is positioned between the coupling point 349 and the coupling point 359 in the wiring 319.

The through-wiring 329 and the through-wiring 339 are electrically coupled to the wiring 519 formed on the second surface 306 as shown in FIG. 9. That is, the through-wirings 329 and 339 pass through the substrate 300 and electrically couple the wirings 319 with 519. As a result, the drive signal COMA input via the electrode 389, is propagated through the wiring 519 via the wiring 319 and the through-wiring 329, and then is supplied to the drive IC 62 via the through-wiring 339, the wiring 319 and the bump electrode 229.

As shown in FIG. 8, the wiring 318 includes a buried wiring 379 buried in the substrate 300 and a surface layer wiring 369 formed so as to cover the buried wiring 379. As described above, since the wiring 319 through which the drive signal COMA is propagated includes the buried wiring 379, the size of the wiring substrate 38 can be reduced, a cross-sectional area of the wiring 319 through which the drive signal COMA is propagated can be increased, and a wiring resistance of the wiring 319 can be reduced.

Similarly, as shown in FIG. 9, the wiring 519 includes a buried wiring 579 buried in the substrate 300 and a surface layer wiring 569 formed so as to cover the buried wiring 579. As described above, since the wiring 519 through which the drive signal COMA is propagated includes the buried wiring 579, the size of the wiring substrate 38 can be reduced, a cross-sectional area of the wiring 519 through which the drive signal COMA is propagated can be increased, and a wiring resistance of the wiring 519 can be reduced.

The wiring 319 is another example of the second wiring, the wiring 519 is another example of the third wiring, the through-wiring 329 is another example of the fourth wiring, and the through-wiring 339 is another example of the fifth wiring. Further, the coupling point 349 is another example of the first coupling point, and the coupling point 359 is another example of the second coupling point. The buried wiring 379 is an example of a first buried wiring, and the buried wiring 579 is an example of a second buried wiring.

As shown in FIG. 8, the electrode 389 may be positioned between the coupling point 349 and the drive IC 62 in a direction along the side 304. As a result, the drive signal COMA supplied from the connection wiring 64 is branched into a path which is propagated through the wiring 319 and is supplied to the drive IC 62, and a path which is propagated through the wiring 519 and is supplied to the drive IC 62, immediately after being input to the electrode 389. Therefore, the current flowing through each of the wiring 319 and the wiring 519 is reduced. Thus, it is possible to reduce a heat generation of the wiring substrate 38 caused by a current based on the propagation of the drive signal COMA, and a voltage drop of the drive signal COMA.

As shown in FIG. 8, the electrode 392 is formed on the wiring 390. The electrode 392 electrically couples the wiring 390 with the coupling wiring 64. The wiring 390 is formed between the wiring 314 and the wiring 315 which are formed on the first surface 305 of the substrate 300, and is formed on a side of the side 301. The reference voltage signal VBS is supplied to the electrode 392. A through-wiring 391 passing through the substrate 300 and electrically coupled to the wiring 390, is formed on a side closer to the side 301 than the electrode 392 in the wiring 390. The through-wiring 391 is electrically coupled to the wiring 390 at a coupling point 393.

The through-wiring 391 is electrically coupled to the wiring 590 formed on the second surface 306 as shown in FIG. 9. That is, the through-wiring 391 passes through the substrate 300 and electrically couples the wirings 319 with 519. As a result, the reference voltage signal VBS input via the electrode 392 is propagated through the wiring 590 via the wiring 390 and the through-wiring 391.

An electrode 153 is formed on the wiring 590. In addition, a bump electrode 143 is provided on the electrode 153. As shown in FIG. 6, the bump electrode 143 is electrically coupled to an upper electrode layer 139 of the piezoelectric element 60 provided on the actuator substrate 36. As a result, the reference voltage signal VBS propagated through the wiring 590 is supplied to the piezoelectric element 60. In the present embodiment, M number of electrodes 153 are formed on the wiring 590 corresponding to each of the M number of nozzles N1 or nozzles N2 forming the line L1 or the line L2. In addition, M number of bump electrodes 143 are provided corresponding to the M number of electrodes 153.

As shown in FIG. 9, the wiring 590 includes a buried wiring 592 buried in the substrate 300 and a surface layer wiring 591 formed so as to cover the buried wiring 592. As described above, since the wiring 590 through which the reference voltage signal VBS is propagated includes the buried wiring 592, the size of the wiring substrate 38 can be reduced, a cross-sectional area of the wiring 590 through which the reference voltage signal VBS is propagated can be increased, and a wiring resistance of the wiring 590 can be reduced.

As shown in FIG. 8, an electrode 171 is formed on the side 303 side of the wiring 310 on the first surface 305 of the substrate 300. The drive signal VOUT supplied from the drive IC 62 to the piezoelectric element 60 corresponding to the nozzle N1 is output to the electrode 171. Further, a through-wiring 173 passing through the substrate 300 and electrically coupled to the electrode 171, is formed on a side 303 side of the electrode 171. As shown in FIG. 9, the through-wiring 173 is electrically coupled to the electrode 151 on the second surface 306. In addition, a bump electrode 141 is provided on the electrode 151.

As shown in FIG. 6, the bump electrode 141 is electrically coupled to a lower electrode layer 137 of the piezoelectric element 60 corresponding to the nozzle N1 provided on the actuator substrate 36. As a result, the drive signal VOUT is supplied to the piezoelectric element 60. In the present embodiment, M number of electrodes 151 are formed along the Y direction corresponding to each of the M number of nozzles N1 forming the line L1. In addition, M number of bump electrodes 141 are provided corresponding to the M number of electrodes 151. In addition, the electrode 171 and the through-wiring 173 which are electrically coupled to the electrode 151 are also formed by M pieces along the Y direction.

As shown in FIG. 8, an electrode 172 is formed on the side 304 side of the wiring 319 on the first surface 305 of the substrate 300. The drive signal VOUT supplied from the drive IC 62 to the piezoelectric element 60 corresponding to the nozzle N2 is output to the electrode 172. Further, a through-wiring 174 passing through the substrate 300 and electrically coupled to the electrode 172, is formed on a side 304 side of the electrode 172. As shown in FIG. 9, the through-wiring 174 is electrically coupled to the electrode 152 on the second surface 306. In addition, a bump electrode 142 is provided on the electrode 152.

As shown in FIG. 6, the bump electrode 142 is electrically coupled to a lower electrode layer 137 of the piezoelectric element 60 corresponding to the nozzle N1 provided on the actuator substrate 36. As a result, the drive signal VOUT is supplied to the piezoelectric element 60. In the present embodiment, M number of electrodes 152 are formed along the Y direction corresponding to each of the M number of nozzles N2 forming the line L2. In addition, M number of bump electrodes 142 are provided corresponding to the M number of electrodes 152. In addition, the electrode 172 and the through-wiring 174 which are electrically coupled to the electrode 152 are also formed by M pieces along the Y direction.

1.6 Operational Effect

As described above, in the liquid discharge head 21 included in the liquid discharge apparatus 1 according to the present embodiment, both the wiring 310 formed on the first surface 305 and the wiring 510 formed on the second surface 306 of the substrate 300 propagate the drive signal COMA in the wiring substrate 38. In this case, the electrode 380 to which the drive signal COMA is supplied is electrically couples the wiring 310 with the wiring 510 in the wiring 310, and is provided between the through-wiring 320 and the through-wiring 330. As a result, a current generated based on the drive signal COMA supplied to the electrode 380 is branched into a path which is propagated through the wiring 310 and is supplied to the drive IC 62, and a path which is propagated through the through-wiring 320, the wiring 510 and the through-wiring 330 and is supplied to the drive IC, immediately after being supplied to the electrode 380. Therefore, the current flowing through each of the wiring 310 and the wiring 510 that propagate drive signal COMA, is reduced. Thus, it is possible to reduce a heat generation of the wiring substrate 38 caused by a current based on the propagation of the drive signal COMA, and a voltage drop of the drive signal COMA.

Note that the same effect can be obtained for each of the wiring 311 and the wiring 511 that propagate the drive signal COMB supplied to the piezoelectric element 60 provided on the line L1, the wiring 319 and the wiring 519 that propagate the drive signal COMA supplied to the piezoelectric element 60 provided on the line L2, and the wiring 318 and the wiring 518 that propagate the drive signal COMB supplied to the piezoelectric element 60 provided on the line L2.

Further, the same effect can be obtained for each of the wiring 312 and the wiring 512 that propagate the high voltage signal VHV supplied to the drive IC 62, and the wiring 317 and the wiring 517 that propagate the low voltage signal VDD.

Further, in the liquid discharge head 21 included in the liquid discharge apparatus 1 according to the present embodiment, since it is possible to reduce the amount of current flowing through the wirings that propagate each of the drive signals COMA and COMB, the high voltage signal VHV, and the low voltage signal VDD in the wiring substrate 38, the heat generation of the wiring substrate 38 caused by a current based on the propagation of each of the drive signals COMA and COMB, the high voltage signal VHV, and the low voltage signal VDD, and the voltage drop of the drive signal COMA can be reduced by providing 600 or more nozzles N in the liquid discharge head 21 even when there is a possibility that the propagated currents increase.

2 Second Embodiment

Next, a liquid discharge apparatus 1, a liquid discharge head 21 and a wiring substrate 38 of a second embodiment will be described. In describing the liquid discharge apparatus 1 of the second embodiment, the same reference numerals are given to the same configurations as those of the first embodiment, and the description thereof will be omitted.

Figure 10:
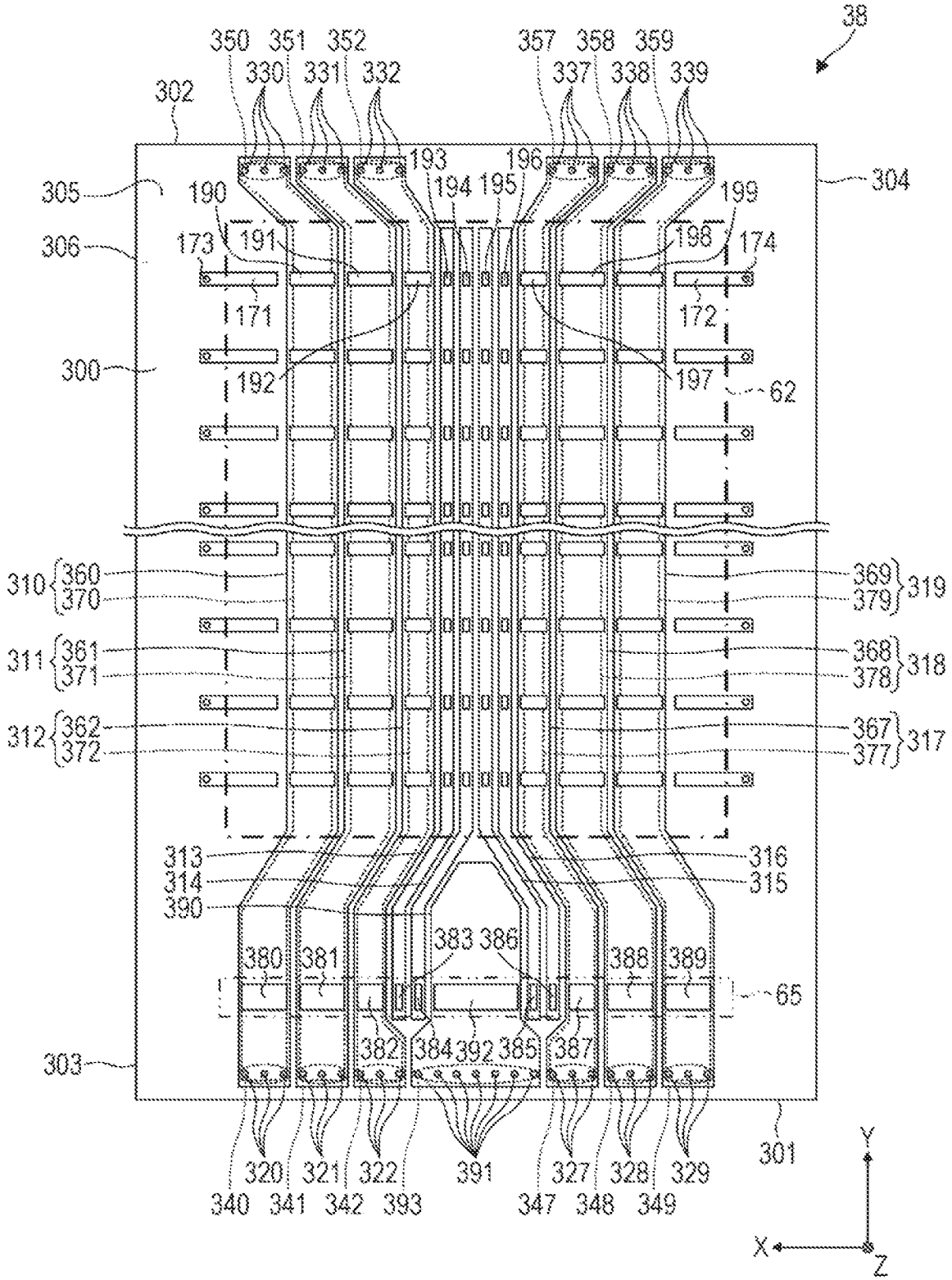
FIG. 10 is a diagram showing a configuration when a wiring substrate of a second embodiment is viewed from a surface.
Figure 11:
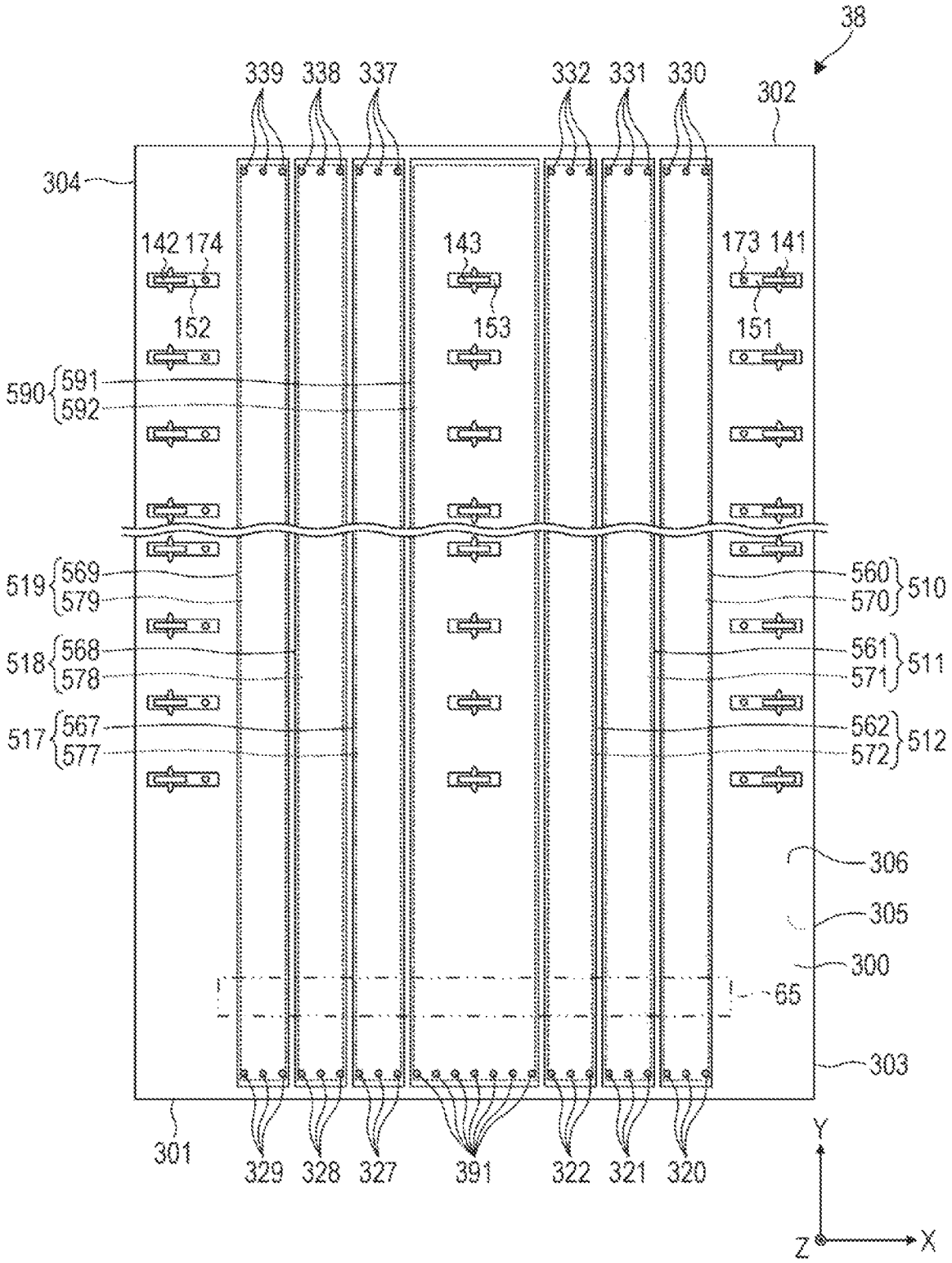
FIG. 11 is a diagram showing a configuration when the wiring substrate of the second embodiment is viewed from a surface.

FIGS. 10 and 11 are diagrams for explaining details of a plurality of wirings and electrodes provided on the wiring substrate 38 of the second embodiment. FIG. 10 is a plan view showing a configuration when the wiring substrate 38 is viewed from the surface G2. FIG. 11 is a plan view showing a configuration when the wiring substrate 38 is viewed from the surface G1. In addition, in FIG. 10, the drive ICs 62 mounted on the wiring substrate 38 are indicated by one-dot chain lines. Further, in FIG. 11, the coupling wiring region 65 to which the coupling wiring 64 is coupled is indicated by a two-dot chain line on the first surface of the substrate 300 included in the wiring substrate 38.

As shown in FIG. 10, the buried wiring 370 is electrically coupled to the through-wiring 320. The buried wiring 370 is also electrically coupled to the through-wiring 330. When viewed from the first surface 305, the buried wiring 370 is provided at a position where a part of buried wiring 370 overlaps with the electrode 380 included in the coupling wiring region 65. The buried wiring 371 is also electrically coupled to the through-wiring 321. The buried wiring 371 is also electrically coupled to the through-wiring 331. When viewed from the first surface 305, the buried wiring 371 is provided at a position where a part of buried wiring 370 overlaps with the electrode 381 included in the coupling wiring region 65. The buried wiring 378 is electrically coupled to the through-wiring 328. The buried wiring 378 is also electrically coupled to the through-wiring 338. When viewed from the first surface 305, the buried wiring 378 is provided at a position where a part of buried wiring 370 overlaps with the electrode 388 included in the coupling wiring region 65. The buried wiring 379 is electrically coupled to the through-wiring 329. The buried wiring 379 is also electrically coupled to the through-wiring 339. When viewed from the first surface 305, the buried wiring 379 is provided at a position where a part of buried wiring 370 overlaps with the electrode 389 included in the coupling wiring region 65.

Further, as shown in FIG. 11, the buried wiring 570 is electrically coupled to the through-wiring 320. The buried wiring 570 is also electrically coupled to the through-wiring 330. When viewed from the first surface 305, the buried wiring 570 is provided at a position where a part of buried wiring 570 overlaps with the electrode 380 included in the coupling wiring region 65. The buried wiring 571 is electrically coupled to the through-wiring 321. The buried wiring 571 is also electrically coupled to the through-wiring 331. When viewed from the first surface 305, the buried wiring 571 is provided at a position where a part of buried wiring 571 overlaps with the electrode 381 included in the coupling wiring region 65. The buried wiring 578 is electrically coupled to the through-wiring 328. The buried wiring 578 is also electrically coupled to the through-wiring 338. When viewed from the first surface 305, the buried wiring 578 is provided at a position where a part of buried wiring 578 overlaps with the electrode 388 included in the coupling wiring region 65. The buried wiring 579 is electrically coupled to the through-wiring 329. The buried wiring 579 is also electrically coupled to the through-wiring 339. When viewed from the first surface 305, the buried wiring 579 is provided at a position where a part of buried wiring 579 overlaps with the electrode 389 included in the coupling wiring region 65.

As described above, the buried wirings 370, 371, 378, and 379 formed on the first surface of the substrate 300 are provided at positions overlapping with the coupling wiring region 65 when viewed from the first surface, and further, the buried wirings 570, 571, 578, and 579 formed on the second surface are provided at positions overlapping with the coupling wiring region 65 when viewed from the first surface. As a result, it is possible to further reduce the wiring resistance of the wirings 310, 311, 318, 319, 510, 511, 518, and 519 to be propagated to the drive IC by the drive signals COMA and COMB supplied from the coupling wiring 64. Thus, it is possible to reduce a heat generation of the wiring substrate 38 caused by a current based on the propagation of each of the drive signals COMA and COMB, and voltage drops of the drive signals COMA and COMB.

3 Third Embodiment

Next, a liquid discharge apparatus 1, a liquid discharge head 21 and a wiring substrate 38 of a third embodiment will be described. In describing the liquid discharge apparatus 1 of the third embodiment, the same reference numerals are given to the same configurations as those of the first embodiment and the second embodiment, and the description thereof will be omitted.

Figure 12:
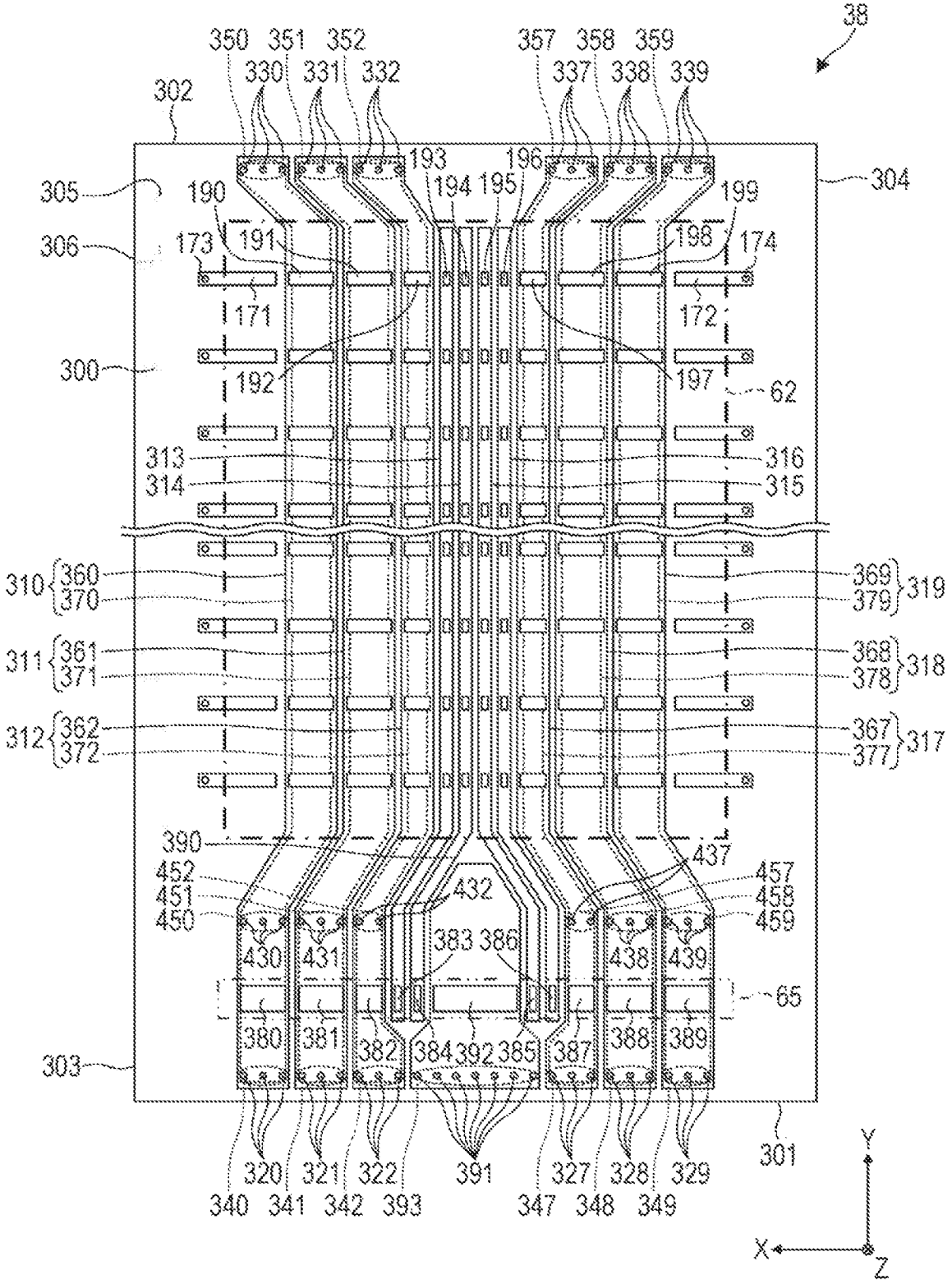
FIG. 12 is a diagram showing a configuration when a wiring substrate of a third embodiment is viewed from a surface.
Figure 13:
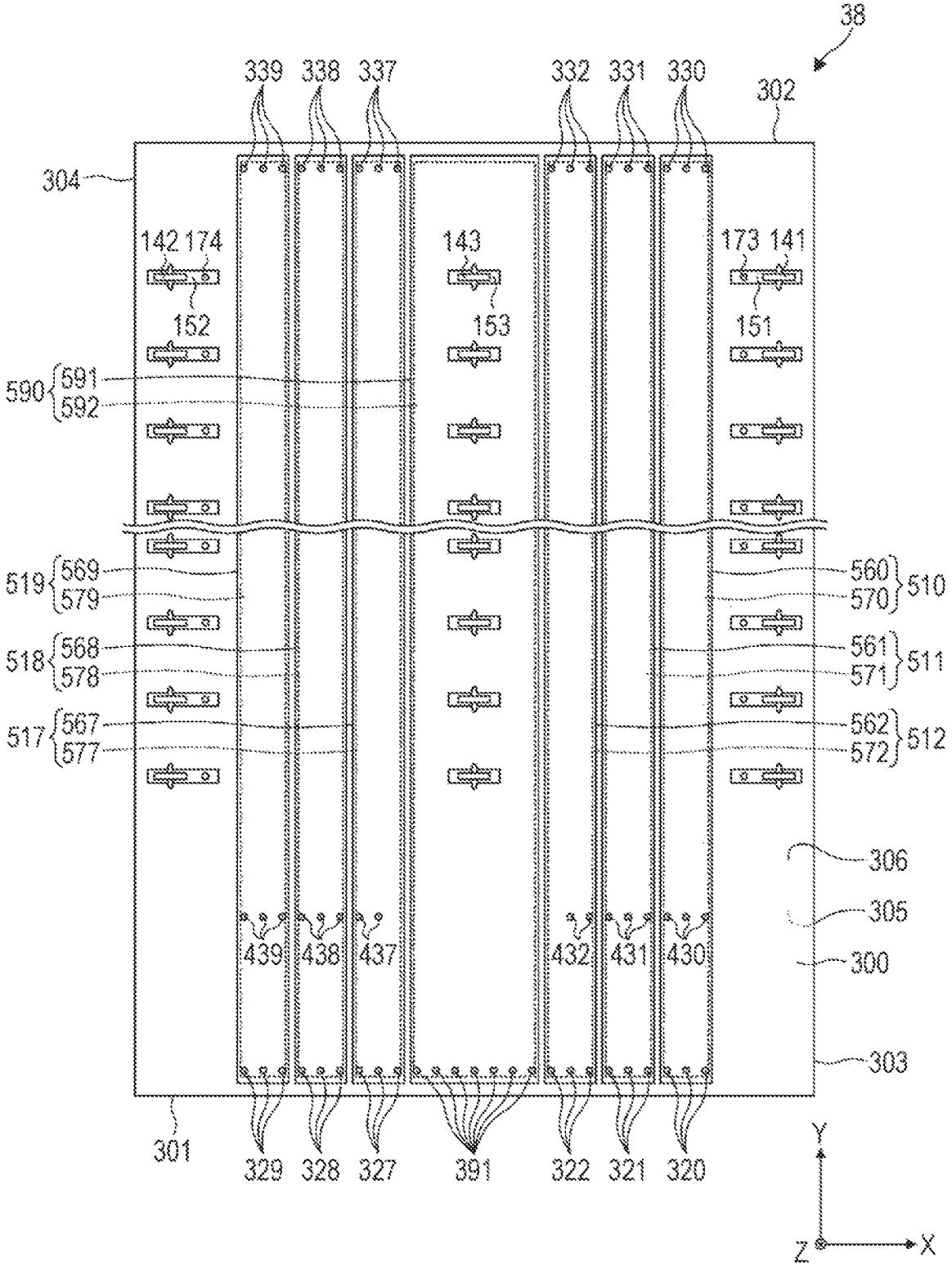
FIG. 13 is a diagram showing a configuration when the wiring substrate of the third embodiment is viewed from a surface.

FIGS. 12 and 13 are diagrams for explaining details of a plurality of wirings and electrodes provided on the wiring substrate 38 of the third embodiment. FIG. 12 is a plan view showing a configuration when the wiring substrate 38 is viewed from the surface G2. FIG. 13 is a plan view showing a configuration when the wiring substrate 38 is viewed from the surface G1. In addition, in FIG. 12, the drive ICs 62 mounted on the wiring substrate 38 are indicated by one-dot chain lines.

As shown in FIG. 12, a through-wiring 430 passing through the substrate 300 and electrically coupled to the wiring 310, is formed between the electrode 380 and the coupling point 350 in the wiring 310. The through-wiring 430 is electrically coupled to the wiring 310 at a coupling point 450. That is, the coupling point 450 is positioned between the electrode 380 and the coupling point 450 in the wiring 310. The through-wiring 430 is electrically coupled to the wiring 510 as shown in FIG. 13.

A wiring length of the path, through which the drive signal COMA supplied to the electrode 380 is propagated through the wiring 310 and is supplied to the drive IC 62, is different from a wiring length of a path, through which the drive signal COMA supplied to the electrode 380 is propagated through the wiring 510 and is supplied to the drive IC 62. Therefore, there is a possibility that the voltage of the drive signal COMA propagated through the wiring 310 and the voltage of the drive signal COMA propagated through the wiring 510 vary.

As shown in FIG. 12 and FIG. 13, variations in voltage between the drive signal COMA propagated through the wiring 310 and the drive signal COMA propagated through the wiring 510 are reduced by forming the through-wiring 430 between the electrode 380 and the coupling point 350 in the wiring 310.

As shown in the FIG. 12, a through-wiring 431 passing through the substrate 300 and electrically coupled to the wiring 311, is formed between the electrode 381 and the coupling point 351 in the wiring 311. The through-wiring 431 is electrically coupled to the wiring 311 at a coupling point 451. That is, the coupling point 451 is positioned between the electrode 381 and the coupling point 451 in the wiring 311. The through-wiring 431 is electrically coupled to the wiring 511 as shown in FIG. 13.

As described above, variations in voltage between the drive signal COMB propagated through the wiring 311 and the drive signal COMB propagated through the wiring 511 are reduced by forming the through-wiring 431 between the electrode 381 and the coupling point 351 in the wiring 311.

As shown in the FIG. 12, a through-wiring 438 passing through the substrate 300 and electrically coupled to the wiring 318, is formed between the electrode 388 and the coupling point 358 in the wiring 318. The through-wiring 438 is electrically coupled to the wiring 318 at a coupling point 458. That is, the coupling point 458 is positioned between the electrode 388 and the coupling point 458 in the wiring 318. The through-wiring 438 is electrically coupled to the wiring 518 as shown in FIG. 13.

As described above, variations in voltage between the drive signal COMB propagated through the wiring 318 and the drive signal COMB propagated through the wiring 518 are reduced by forming the through-wiring 438 between the electrode 388 and the coupling point 358 in the wiring 318.

As shown in the FIG. 12, a through-wiring 439 passing through the substrate 300 and electrically coupled to the wiring 319, is formed between the electrode 389 and the coupling point 359 in the wiring 319. The through-wiring 439 is electrically coupled to the wiring 319 at a coupling point 459. That is, the coupling point 459 is positioned between the electrode 389 and the coupling point 459 in the wiring 319. The through-wiring 439 is electrically coupled to the wiring 519 as shown in FIG. 13.

As described above, variations in voltage between the drive signal COMA propagated through the wiring 319 and the drive signal COMA propagated through the wiring 519 are reduced by forming the through-wiring 439 between the electrode 389 and the coupling point 359 in the wiring 319.

Therefore, in the liquid discharge apparatus 1, the liquid discharge head 21, and the wiring substrate 38 in the third embodiment, in addition to the effects described in the first embodiment and the second embodiment, it is possible to reduce variations in voltage generated in the drive signals COMA and COMB.

Here, one of the through-wirings 430, 431, 438, and 439 is an example of a sixth wiring, and one of the coupling points 450, 451, 458, and 459 is an example of a third coupling point.

4 Fourth Embodiment

Next, a liquid discharge apparatus 1, a liquid discharge head 21 and a wiring substrate 38 of a fourth embodiment will be described. In describing the liquid discharge apparatus 1 of the fourth embodiment, the same reference numerals are given to the same configurations as those of the first embodiment, the second embodiment, and the third embodiment, and the description thereof will be omitted.

Figure 14:
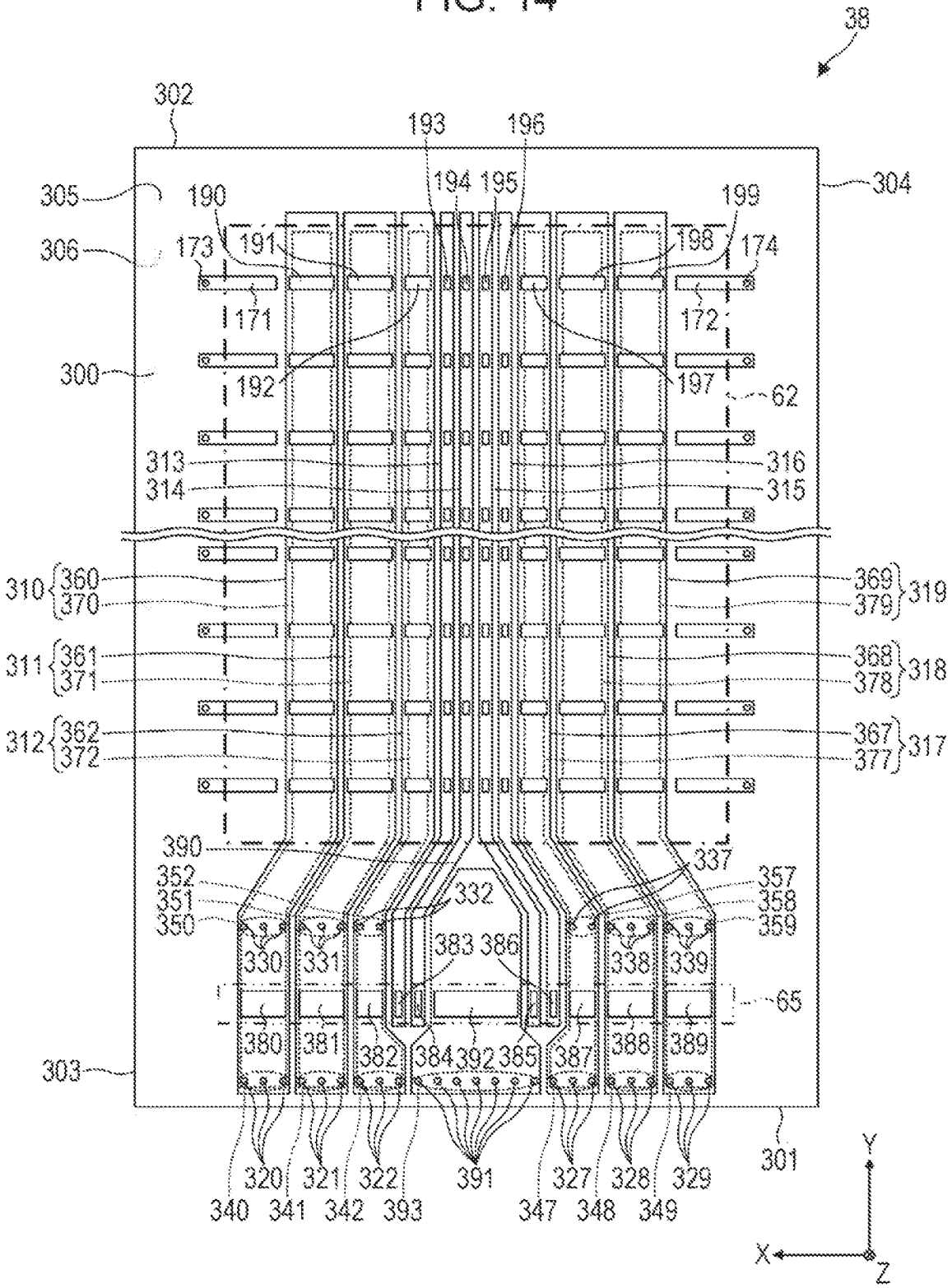
FIG. 14 is a diagram showing a configuration when a wiring substrate of a fourth embodiment is viewed from a surface.
Figure 15:
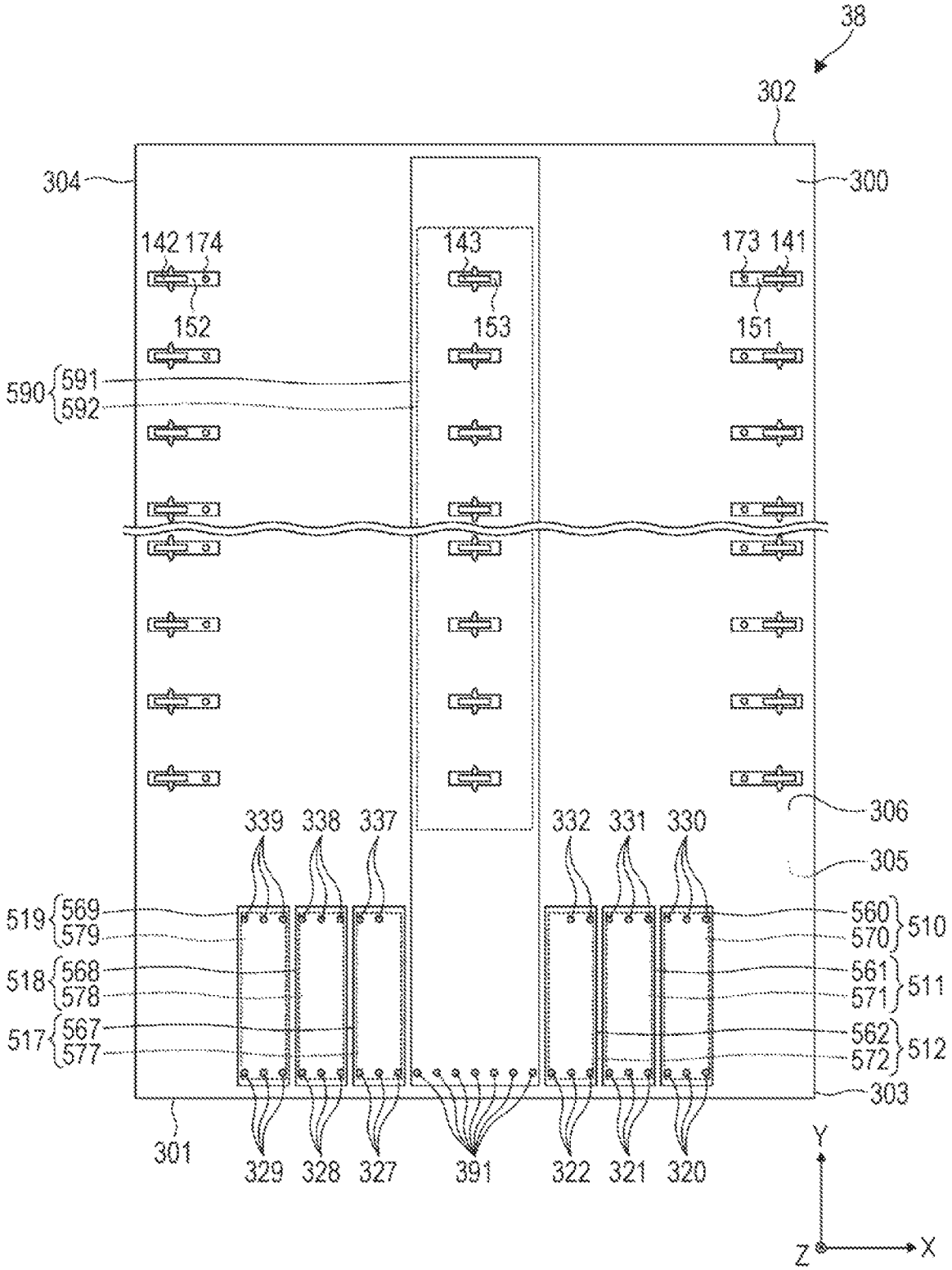
FIG. 15 is a diagram showing a configuration when the wiring substrate of the fourth embodiment is viewed from a surface.

FIGS. 14 and 15 are diagrams for explaining details of a plurality of wirings and electrodes provided on the wiring substrate 38 of the fourth embodiment. FIG. 14 is a plan view showing a configuration when the wiring substrate 38 is viewed from the surface G2. FIG. 15 is a plan view showing a configuration when the wiring substrate 38 is viewed from the surface G1. In addition, in FIG. 14, the drive ICs 62 mounted on the wiring substrate 38 are indicated by one-dot chain lines.

As shown in FIG. 14, in the liquid discharge apparatus 1 of the fourth embodiment, through-wirings 330, 331, 338, and 339 passing through the substrate 300 of the wiring substrate 38 are positioned between the coupling wiring region 65 and the drive IC 62. A current generated due to the drive signals COMA and COMB input to the wiring substrate 38 becomes the largest in the coupling wiring region 65. The current gradually decreases as the drive signals COMA and COMB are supplied to the drive IC 62 and the piezoelectric element 60.

Therefore, as shown in the fourth embodiment, it is possible to reduce the heat generation and the voltage drop occurring in the wiring substrate 38 in the coupling wiring region 65 where the largest current flows by providing the through-wirings 330, 331, 338, and 339 passing through the substrate 300 of the wiring substrate 38 between the coupling wiring region 65 and the drive IC 62.

Further, as shown in FIG. 15, since a region where the wirings 510, 511, 512, 517, 518, and 519 are formed on the second surface 306 of the substrate 300 can be reduced, it is possible to miniaturize the wiring substrate by providing a control wiring or the like in the region. Therefore, in the liquid discharge apparatus 1, the liquid discharge head 21, and the wiring substrate 38 in the fourth embodiment, in addition to the effects described in the first embodiment, the wiring substrate 38 can be miniaturized.

What is claimed is:

1. A liquid discharge head comprising:

a drive element driven by a drive signal supplied thereto;

an actuator substrate provided with the drive element;

drive circuit chip that controls a supply of the drive signal to the drive element;

a wiring substrate that propagates a source signal to the drive circuit chip and propagates the drive signal to the drive element, the wiring substrate having first and second surfaces facing outwardly opposite to each other; and a first wiring through which the source signal is input to the wiring substrate via an input electrode on the first surface of the wiring substrate, wherein the wiring substrate has:

a first side and a second side that is longer than the first side;

a second wiring formed on the first surface and extending from one end to the other end of the wiring substrate along a first direction, the second side of the wiring substrate being along the first direction;

a third wiring formed on the second surface and extending from the one end to the other end of the wiring substrate along the first direction, the second wiring partially overlapping the third wiring in a plan view;

a first through wiring formed in the wiring substrate at the one end and electrically connecting between the second and third wirings;

a second through wiring formed in the wiring substrate at the other end and electrically connecting between the second and third wirings;

a first output electrode formed on the first surface at the other end;

a second output electrode formed on the second surface at the other end; and a third through wiring formed in the wiring substrate at the other end and electrically connecting between the first and second output electrodes, wherein the input electrode is formed on the second wiring at a position between the one end and the other end, the source signal travels from the first wiring to the second wiring via the input electrode, from the second wiring to the third wiring via the first and second through wirings, and from the second wiring to the drive circuit chip, and the drive signal travels from the drive circuit chip to the first output electrode to the second output electrode via the third through wiring, and from the second output electrode to the drive element.

2. The liquid discharge head according to claim 1, wherein the input electrode is provided between the fourth first through wiring and the second through wiring along the second side of the wiring substrate.

3. The liquid discharge head according to claim 1, wherein the drive circuit chip is provided on the wiring substrate, and the input electrode is provided between the first through wiring and the drive circuit chip along the second side of the wiring substrate.

4. The liquid discharge head according to claim 1, wherein the second wiring includes a first buried wiring buried in the wiring substrate, the third wiring includes a second buried wiring buried in the wiring substrate, and a part of the first buried wiring overlaps with the input electrode in the plan view and a part of the second buried wiring overlaps with the input electrode in the plan view.

5. The liquid discharge head according to claim 1, wherein the wiring substrate further includes:

a fourth through wiring formed in the wiring substrate and electrically connecting between the second and third wirings, and the fourth through wiring is located between the input electrode and the second through wiring along the first direction.

6. A liquid discharge apparatus comprising:

an external drive circuit configured to output a drive signal; and a liquid discharge head, the liquid discharge head having:

a drive element driven by the drive signal supplied from the external drive circuit;

an actuator substrate provided with the drive element;

a drive circuit chip that receives the drive signal from the external drive circuit to control a supply of the drive signal to the drive element;

a wiring substrate that propagates a source signal to the drive circuit chip and propagates the drive signal to the drive element, the wiring substrate having first and second surfaces facing outwardly opposite to each other; and a first wiring through which the source signal is input to the wiring substrate via an input electrode on the first surface of the wiring substrate, wherein the wiring substrate has:

a first side and a second side that is longer than the first side;

a second wiring formed on the first surface and extending from one end to the other end of the wiring substrate along a first direction, the second side of the wiring substrate being along the first direction;

a third wiring formed on the second surface and extending from the one end to the other end of the wiring substrate along the first direction, the second wiring partially overlapping the third wiring in a plan view;

a first through wiring formed in the wiring substrate at the one end and electrically connecting between the second and third wirings;

a second through wiring formed in the wiring substrate at the other end and electrically connecting between the second and third wirings;

a first output electrode formed on the first surface at the other end;

a second output electrode formed on the second surface at the other end; and a third through wiring formed in the wiring substrate at the other end and electrically connecting between the first and second output electrodes, wherein the input electrode is formed on the second wiring at a position between the one end and the other end, the source signal travels from the first wiring to the second wiring via the input electrode, from the second wiring to the third wiring via the first and second through wirings, and from the second wiring to the drive circuit chip, and the drive signal travels from the drive circuit chip to the first output electrode to the second output electrode via the third through wiring, and from the second output electrode to the drive element.

7. A wiring substrate provided in a liquid discharge head, the wiring substrate having first and second surfaces facing outwardly opposite to each other, the liquid discharge head including a drive element driven by a drive signal supplied thereto, an actuator substrate provided with the drive element, a drive circuit chip that controls a supply of the drive signal to the drive element, and a first wiring through which a source signal is input to the wiring substrate via an input electrode on the first surface of the wiring substrate, the wiring substrate propagating the source signal to the drive circuit chip and propagating the drive signal to the drive element, the wiring substrate comprising:

a first side and a second side that is longer than the first side;

a second wiring formed on the first surface and extending from one end to the other end of the wiring substrate along a first direction, the second side of the wiring substrate being along the first direction;

a third wiring formed on the second surface and extending from the one end to the other end of the wiring substrate along the first direction, the second wiring partially overlapping the third wiring in a plan view;

a first through wiring formed in the wiring substrate at the one end and electrically connecting between the second and third wirings;

a second through wiring formed in the wiring substrate at the other end and electrically connecting between the second and third wirings;

a first output electrode formed on the first surface at the other end;

a second output electrode formed on the second surface at the other end; and a third through wiring formed in the wiring substrate at the other end and electrically connecting between the first and second output electrodes, wherein the input electrode is formed on the second wiring at a position between the one end and the other end, the source signal travels from the first wiring to the second wiring via the input electrode, from the second wiring to the third wiring via the first and second through wirings, and from the second wiring to the drive circuit chip, and the drive signal travels from the drive circuit chip to the first output electrode to the second output electrode via the third through wiring, and from the second output electrode to the drive element.

* * * * *